US010926849B1

(12) United States Patent
Orth

(10) Patent No.: US 10,926,849 B1
(45) Date of Patent: Feb. 23, 2021

(54) MANUALLY PROPELLED WATER SKIS

(71) Applicant: ORTH CONSULTING, LLC, Maineville, OH (US)

(72) Inventor: Donald S. Orth, Cincinnati, OH (US)

(73) Assignee: ORTH CONSULTING, LLC, Maineville, OH (US)

( * ) Notice: Subject to any disclaimer, the term of this patent is extended or adjusted under 35 U.S.C. 154(b) by 0 days.

(21) Appl. No.: 16/864,833

(22) Filed: May 1, 2020

(51) Int. Cl.
*B63B 34/56* (2020.01)
*B63B 34/565* (2020.01)
*B63B 34/52* (2020.01)

(52) U.S. Cl.
CPC ..... *B63B 34/56* (2020.02); *B63B 34/565* (2020.02); *B63B 34/52* (2020.02)

(58) Field of Classification Search
CPC ..... B63B 34/565; B63B 34/56; B63B 32/30
See application file for complete search history.

(56) References Cited

U.S. PATENT DOCUMENTS 1,049,661 A 1/1913 Bretney
1,714,352 A 10/1927 Echola
3,034,157 A 4/1958 Abajian
3,031,696 A 12/1958 Brabb
3,027,576 A 9/1959 Fines
3,063,071 A * 11/1962 Van Vorst ..... B63B 34/56 441/77
3,067,440 A * 12/1962 Blake ..... B63B 32/20 441/68
3,084,356 A 4/1963 Wheat
3,242,898 A 3/1966 Livaudais
3,408,086 A 10/1968 Bennett
3,541,623 A 11/1970 Duda
3,566,427 A 3/1971 Davis et al.
3,601,828 A 8/1971 Fairchild
3,758,898 A 9/1973 Dougherty
3,783,532 A 1/1974 Harradine
3,835,494 A 9/1974 Dougherty
3,936,897 A 2/1976 Schaumann
3,952,353 A 4/1976 Word
4,034,430 A 7/1977 Joyce
4,117,562 A 10/1978 Schaumann
(Continued)

FOREIGN PATENT DOCUMENTS

DE 10353625 A1 * 6/2005 ..... B63B 34/56
EP 1663773 B1 4/2013

*Primary Examiner* — Andrew Polay
(74) *Attorney, Agent, or Firm* — David R. Stevens; Stevens Law Group

(57) ABSTRACT

Manually propelled water skis support a person skiing on water. The water ski includes a base having a binding on an upper surface and propulsion structures on the bottom surface. The propulsion structures include a rearward facing and vertical propulsion surface and a forward facing and sloped surface such that drag is greater when the water ski is moved rearwardly. The propulsion surface may be arcuate, V-shape, U-shaped, or other shaped in a horizontal plane and may also be concave in a vertical plane. Buoyancy structures may be secured to the upper surface of the base forward and rearward of the binding. Water ski poles including elliptical floats at the bottom ends may be used to provide a synergistic increase in waterskiing speed. Straps on the base near the binding may be used to secure the water ski poles to the base in order to form an outrigger.

19 Claims, 11 Drawing Sheets

(56) References Cited

U.S. PATENT DOCUMENTS

| | | | | |
|---|---|---|---|---|
| 4,157,597 | A | 6/1979 | Trebnick | |
| 4,261,069 | A | 4/1981 | Schaumann | |
| 4,527,984 | A | 7/1985 | Gilbert | |
| 4,731,039 | A | 3/1988 | Zeiss | |
| 4,773,886 | A | 9/1988 | Teeter et al. | |
| 4,915,659 | A | 4/1990 | Sanders | |
| 4,952,184 | A | 8/1990 | Graziano | |
| 5,080,621 | A | 1/1992 | Nayes | |
| 5,120,249 | A | 6/1992 | Fonda | |
| 5,167,552 | A | 12/1992 | Johnson, III | |
| 5,236,381 | A | 8/1993 | Keogh | |
| 5,338,275 | A | 8/1994 | Chek | |
| 5,429,537 | A | 7/1995 | Seith | |
| 5,558,553 | A | 9/1996 | Okano | |
| 5,575,412 | A * | 11/1996 | Arias | A63C 11/025 224/257 |
| 5,593,334 | A | 1/1997 | Thayer | |
| 5,697,822 | A | 12/1997 | Souter | |
| 6,764,363 | B2 | 7/2004 | Rosen | |
| 6,855,024 | B2 | 2/2005 | Rothschild | |
| 7,048,599 | B1 | 5/2006 | Garwood et al. | |
| 7,607,959 | B2 * | 10/2009 | DeMint | B63H 16/08 441/76 |
| 9,290,244 | B2 | 3/2016 | Souter | |
| 9,376,178 | B2 | 6/2016 | Suckewer | |
| 9,517,819 | B2 | 12/2016 | Souter | |
| 9,611,019 | B2 | 4/2017 | Spencer | |
| 9,902,473 | B2 | 2/2018 | Souter | |
| 10,472,027 | B1 | 11/2019 | Croft | |
| 2002/0115364 | A1 | 8/2002 | Ko | |
| 2008/0100035 | A1 * | 5/2008 | Schultz | B63B 34/56 280/615 |
| 2018/0194443 | A1 | 7/2018 | Carril | |

* cited by examiner

Calculation of area provided by Arcs on Bottom of Skis

| | Area of Arcs Height of arcs | Area of concave arc | Width of ski | Area of Arcs | Number of Arcs | Total Area of Arcs (square inches) on Bottom of Each Ski |
|---|---|---|---|---|---|---|
| Sks 6' long and 8" wide | 0.5 | 0.79 | 8 | 9.89 | 12 | 119 |
| For small people | 0.5 | 0.79 | 8 | 9.89 | 15 | 148 |
| | 0.5 | 0.79 | 8 | 9.89 | 18 | 178 |
| Skis 6' long and 12" wide | 0.5 | 0.79 | 12 | 14.83 | 12 | 178 |
| For medium weight people | 0.5 | 0.79 | 12 | 14.83 | 15 | 222 |
| | 0.5 | 0.79 | 12 | 14.83 | 18 | 267 |
| Skis 8' long and 8" wide | 0.5 | 0.79 | 8 | 9.89 | 12 | 119 |
| For medium weight people | 0.5 | 0.79 | 8 | 9.89 | 15 | 148 |
| | 0.5 | 0.79 | 8 | 9.89 | 18 | 178 |
| Skis 8' long and 12" wide | 0.5 | 0.79 | 12 | 14.83 | 12 | 178 |
| For heavy people | 0.5 | 0.79 | 12 | 14.83 | 15 | 222 |
| | 0.5 | 0.79 | 12 | 14.83 | 18 | 267 |
| Skis 6' long and 8" wide | 1 | 1.57 | 8 | 19.77 | 12 | 237 |
| For small people | 1 | 1.57 | 8 | 19.77 | 15 | 297 |
| | 1 | 1.57 | 8 | 19.77 | 18 | 356 |
| Skis 6' long and 12" wide | 1 | 1.57 | 12 | 29.66 | 12 | 356 |
| For medium weight people | 1 | 1.57 | 12 | 29.66 | 15 | 445 |
| | 1 | 1.57 | 12 | 29.66 | 18 | 534 |
| Skis 8' long and 8" wide | 1 | 1.57 | 8 | 19.77 | 12 | 237 |
| For medium weight people | 1 | 1.57 | 8 | 19.77 | 15 | 297 |
| | 1 | 1.57 | 8 | 19.77 | 18 | 356 |
| Skis 8' long and 12" wide | 1 | 1.57 | 12 | 29.66 | 12 | 356 |
| For heavy people | 1 | 1.57 | 12 | 29.66 | 15 | 445 |
| | 1 | 1.57 | 12 | 29.66 | 18 | 534 |

FIG. 11

Calculations of Ski Size needed for Small, Medium, and Heavy People

| | Water Ski Displacement | | | | | Front Bouyancy Structure | | | | | Rear Bouyancy Structure | | | | | Total Displacement |
|---|---|---|---|---|---|---|---|---|---|---|---|---|---|---|---|---|
| | L | W | T | Disp. | lbs | L | W | T | Disp | lbs | L | W | T | Disp. | lbs | Per Ski |
| Skis 4' long and 8" wide | 48 | 8 | 2 | 768 | 28 | 16 | 7 | 1 | 112 | 4 | 16 | 7 | 1 | 112 | 4 | 36 Pounds |
| Skis 4' long and 12" wide | 48 | 12 | 2 | 1152 | 42 | 16 | 11 | 1 | 176 | 6 | 16 | 11 | 1 | 176 | 6 | 54 Pounds |
| Skis 6' long and 8" wide | 72 | 8 | 2 | 1152 | 42 | 28 | 7 | 1 | 196 | 7 | 28 | 7 | 1 | 196 | 7 | 56 Pounds |
| Skis 6' long and 10" wide | 72 | 10 | 2 | 1440 | 52 | 28 | 9 | 1 | 252 | 9 | 28 | 9 | 1 | 252 | 9 | 70 Pounds |
| Skis 6' long and 12" wide | 72 | 12 | 2 | 1728 | 62 | 28 | 11 | 1 | 308 | 11 | 28 | 11 | 1 | 308 | 11 | 85 Pounds |
| Skis 8' long and 8" wide | 96 | 8 | 2 | 1536 | 55 | 34 | 7 | 1 | 238 | 9 | 34 | 7 | 1 | 238 | 9 | 73 Pounds |
| Skis 8' long and 10" wide | 96 | 10 | 2 | 1920 | 69 | 34 | 9 | 1 | 306 | 11 | 34 | 9 | 1 | 306 | 11 | 91 Pounds |
| Skis 8' long and 12" wide | 96 | 12 | 2 | 2304 | 83 | 34 | 11 | 1 | 374 | 14 | 34 | 11 | 1 | 374 | 14 | 110 Pounds |
| Skis 9' long and 12" wide | 108 | 12 | 2 | 2592 | 94 | 46 | 11 | 1 | 506 | 18 | 46 | 11 | 1 | 506 | 18 | 130 Pounds |
| Skis 4' long and 8" wide | 48 | 8 | 2 | 768 | 28 | 16 | 7 | 2 | 224 | 8 | 16 | 7 | 2 | 224 | 8 | 44 Pounds |
| Skis 4' long and 12" wide | 48 | 12 | 2 | 1152 | 42 | 16 | 11 | 2 | 352 | 13 | 16 | 11 | 2 | 352 | 13 | 67 Pounds |
| Skis 6' long and 8" wide | 72 | 8 | 2 | 1152 | 42 | 28 | 7 | 2 | 392 | 14 | 28 | 7 | 2 | 392 | 14 | 70 Pounds |
| Skis 6' long and 10" wide | 72 | 10 | 2 | 1440 | 52 | 28 | 9 | 2 | 504 | 18 | 28 | 9 | 2 | 504 | 18 | 88 Pounds |
| Skis 6' long and 12" wide | 72 | 12 | 2 | 1728 | 62 | 28 | 11 | 2 | 616 | 22 | 28 | 11 | 2 | 616 | 22 | 107 Pounds |
| Skis 8' long and 8" wide | 96 | 8 | 2 | 1536 | 55 | 34 | 7 | 2 | 476 | 17 | 34 | 7 | 2 | 476 | 17 | 90 Pounds |
| Skis 8' long and 10" wide | 96 | 10 | 2 | 1920 | 69 | 34 | 9 | 2 | 612 | 22 | 34 | 9 | 2 | 612 | 22 | 114 Pounds |
| Skis 8' long and 12" wide | 96 | 12 | 2 | 2304 | 83 | 34 | 11 | 2 | 748 | 27 | 34 | 11 | 2 | 748 | 27 | 137 Pounds |
| Skis 9' long and 12" wide | 108 | 12 | 2 | 2592 | 94 | 46 | 11 | 2 | 1012 | 37 | 46 | 11 | 2 | 1012 | 37 | 167 Pounds |
| Skis 4' long and 8" wide | 48 | 8 | 3 | 1152 | 42 | 0 | 7 | 1 | 0 | 0 | 0 | 7 | 1 | 0 | 0 | 42 Pounds |
| Skis 4' long and 12" wide | 48 | 12 | 3 | 1728 | 62 | 0 | 11 | 1 | 0 | 0 | 0 | 11 | 1 | 0 | 0 | 62 Pounds |
| Skis 6' long and 8" wide | 72 | 8 | 3 | 1728 | 62 | 0 | 7 | 1 | 0 | 0 | 0 | 7 | 1 | 0 | 0 | 62 Pounds |
| Skis 6' long and 10" wide | 72 | 10 | 3 | 2160 | 78 | 0 | 9 | 1 | 0 | 0 | 0 | 9 | 1 | 0 | 0 | 78 Pounds |
| Skis 6' long and 12" wide | 72 | 12 | 3 | 2592 | 94 | 0 | 11 | 1 | 0 | 0 | 0 | 11 | 1 | 0 | 0 | 94 Pounds |
| Skis 8' long and 8" wide | 96 | 8 | 3 | 2304 | 83 | 0 | 7 | 1 | 0 | 0 | 0 | 7 | 1 | 0 | 0 | 83 Pounds |
| Skis 8' long and 10" wide | 96 | 10 | 3 | 2880 | 104 | 0 | 9 | 1 | 0 | 0 | 0 | 9 | 1 | 0 | 0 | 104 Pounds |
| Skis 8' long and 12" wide | 96 | 12 | 3 | 3456 | 125 | 0 | 11 | 1 | 0 | 0 | 0 | 11 | 1 | 0 | 0 | 125 Pounds |
| Skis 9' long and 12" wide | 108 | 12 | 3 | 3888 | 140 | 0 | 11 | 1 | 0 | 0 | 0 | 11 | 1 | 0 | 0 | 140 Pounds |
| Skis 4' long and 8" wide | 48 | 8 | 4 | 1536 | 55 | 0 | 7 | 2 | 0 | 0 | 0 | 7 | 2 | 0 | 0 | 55 Pounds |
| Skis 4' long and 12" wide | 48 | 12 | 4 | 2304 | 83 | 0 | 11 | 2 | 0 | 0 | 0 | 11 | 2 | 0 | 0 | 83 Pounds |
| Skis 6' long and 8" wide | 72 | 8 | 4 | 2304 | 83 | 0 | 7 | 2 | 0 | 0 | 0 | 7 | 2 | 0 | 0 | 83 Pounds |
| Skis 6' long and 10" wide | 72 | 10 | 4 | 2880 | 104 | 0 | 9 | 2 | 0 | 0 | 0 | 9 | 2 | 0 | 0 | 104 Pounds |
| Skis 6' long and 12" wide | 72 | 12 | 4 | 3456 | 125 | 0 | 11 | 2 | 0 | 0 | 0 | 11 | 2 | 0 | 0 | 125 Pounds |
| Skis 8' long and 8" wide | 96 | 8 | 4 | 3072 | 111 | 0 | 7 | 2 | 0 | 0 | 0 | 7 | 2 | 0 | 0 | 111 Pounds |
| Skis 8' long and 10" wide | 96 | 10 | 4 | 3840 | 139 | 0 | 9 | 2 | 0 | 0 | 0 | 9 | 2 | 0 | 0 | 139 Pounds |
| Skis 8' long and 12" wide | 96 | 12 | 4 | 4608 | 166 | 0 | 11 | 2 | 0 | 0 | 0 | 11 | 2 | 0 | 0 | 166 Pounds |
| Skis 9' long and 12" wide | 108 | 12 | 4 | 5184 | 187 | 0 | 11 | 2 | 0 | 0 | 0 | 11 | 2 | 0 | 0 | 187 Pounds |

FIG. 12

MANUALLY PROPELLED WATER SKIS

BACKGROUND

Field of the Invention

This invention relates to personal flotation devices that enable a user to move forward on the surface of water in a self-propelled manner.

Background of the Invention

Water skiing was invented in 1922 when Ralph Samuelson used a pair of boards as skis and a clothesline as a towrope on Lake Pepin in Lake City, Minn. His brother Ben towed him with a boat, and they reached a speed of 20 miles per hour. Samuelson went through several iterations of equipment in his quest to ski on water. He fabricated his own ski design out of lumber with bindings made of strips of leather. One of the first U.S. Patents for water skis was issued to Fred Waller, of Huntington, N.Y., on Oct. 27, 1925, as U.S. Pat. No. 1,559,390 for skis he developed independently and marketed as "Dolphin Akwa-Skees."

Currently, water skiing is a surface water sport in which the skier is pulled behind a boat with a ski rope at a speed sufficient to enable the skier on one or two skis to plane on the surface of the water. The sport requires sufficient area on a smooth stretch of water for a boat with tow rope to pull the skier, one or two skis, a personal flotation device such as a water ski vest, and two or more people to drive the boat and watch the skier (depending on state boating laws). Similar related sports that involve towing the individual with a boat include wakeboarding, knee boarding, discing, tubing, and hydro foiling.

Inventors have attempted to design water skis that do not require a tow boat, and which would enable the skier to ski or "walk on water." Such implementations often include a left-foot and a right-foot hull. Some are also used in combination with water ski poles with attached propulsion pontoons. The hulls of such implementations often include hinged plates (see, e.g., U.S. Pat. No. 3,027,576). In another approach, the lower surface of a hull is smooth and flat except for recesses extending upwardly into the hull from the lower surface and which are asymmetric front to back in order to provide propulsion (U.S. Pat. No. 3,566,427).

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which:

FIG. 11 is a table listing example sizing for water skis for users of different weights in accordance with an embodiment of the present invention; and FIG. 12 is a table listing the displacement of different size water skis in accordance with an embodiment of the present invention.

DETAILED DESCRIPTION

Figure 1A:
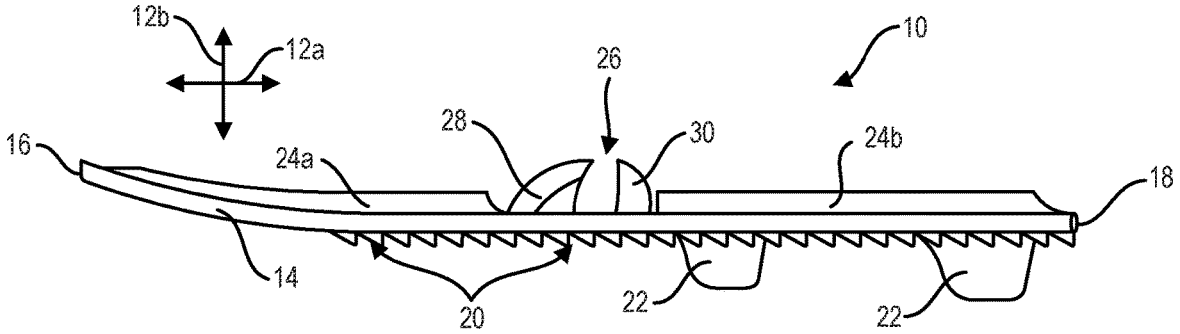
FIG. 1A is a side view of a first water ski in accordance with an embodiment of the present invention.

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. Furthermore, there is no intention to be bound by any expressed or implied theory presented in the preceding technical information, background, brief summary or in the detailed description given below. Also, it is to be understood that the specific devices and practices illustrated in the accompanying drawings, and described in the following specifications, are simply exemplary embodiments of the invention concepts defined in the accompanying claims. Thus, precise dimensions and other physical characteristics relating to the embodiments described herein are not to be considered as limiting, unless the claims explicitly state otherwise.

This application is directed to water skis configured to enable a user to move forward on the surface of water in a self-propelled manner. Water ski poles are also disclosed and provide stability and an increase in propulsion that enables the user to attain faster speeds when water skiing. The presently described embodiments will be best understood by reference to the drawings, wherein like parts are designated by like numerals throughout.

Referring to FIGS. 1A to 1F, a water ski 10 may be understood with respect to a longitudinal direction 12*a* corresponding generally to the direction of movement of the ski 10, a vertical direction 12*b* corresponding generally to the direction of gravity and perpendicular to the longitudinal direction 12*a*, and a transverse direction 12*c* perpendicular to the longitudinal direction 12*a* and the vertical direction 12*b*.

The water ski 10 may include a base 14 that is planar along a major portion, e.g. at least 60 percent, of its length along the longitudinal direction 12*a*, the top and bottom surfaces of the planar portion being parallel to the longitudinal direction 12*a* and the transverse direction 12*c*. The base 14 is much thinner along the vertical direction 12*b* than the width in the transverse direction 12*c*, e.g. a thickness of 5 to 25 percent of the width. In some embodiments, the base 14 is between 4 and 18 inches wide and between about 1 and two inches thick (e.g., about meaning+/−0.5 inches). For example, the base 14 may be 8 inches wide. In some embodiments, the base 14 is about 8 feet long (e.g., +/−1 foot).

The base 14 may be ski-shaped including an upwardly curved portion extending from a tip 16 to the planar portion. The upwardly curved portion may also have a width that tapers toward a rounded point at the tip 16. The planar portion extends from the curved portion to the rearward end 18 of the base 14. In some embodiments, curvature of the curved portion is such that the top of the tip 16 is at least two inches above the top surface of the planar portion.

The base 14 may be a structural member configured to support the weight of a user standing on the base 14 and provide buoyancy acting upwardly along the length of the base 14. The base 14 may be inherently buoyant or not. The base 14 may be formed of wood, plastic, composite material, or other type of material. The base 14 may be made of high-density polyethylene (HDPE), expanded polystyrene (EPS) foam, high-density polyurethane foam, or other type of polymer foam. For example, the base 14 may be a hollow or foam-filled shell coated with plastic or composite material (e.g., fiberglass, carbon fiber, etc.). An example approach for constructing the base 14 is described below with respect to FIG. 6.

An array of propulsion structures 20 are secured the bottom surface of the base 14 and may be integrally secured to the base 14, monolithically formed with the base 14, or secured to the base 14 by some other means. As is apparent in FIG. 1A, the propulsion structures 20 extend downwardly from the planar bottom surface of the base 14. In some embodiments, propulsion structures 20 may extend downwardly from a portion of the curved portion as well. The propulsion structures 20 may be distributed along the base 14 at uniform intervals, such as every four inches starting 24 inches from the tip 16 measured along the longitudinal direction 12*a*. Alternatively, the distribution of the propulsion structures 20 along the base 14 may be non-uniform.

As will be described in detail below, the propulsion structures 20 provide a directionally-dependent degree of hydrodynamic drag such that as the water ski 10 is thrust forwardly (movement along the longitudinal direction 12*a* with tip 16 at leading end) the drag induced by the propulsion structures 20 is less than when the water ski 10 is thrust rearwardly (movement along the longitudinal direction 12*a* with rearward end 18 at leading end).

For example, the hydrodynamic drag on the water ski 10 for a forward thrust at 4 miles per hour (MPH) may be between 0.1 and 0.5 times the hydrodynamic drag for a rearward thrust at the same speed, preferably between 0.1 and 0.3 times. In one example, if the propulsion structures 20 have a combined area of 356 square inches (18 semicircular 1 inch high arcs), a difference in pressure of just 0.56 psi between a first water ski 10 and a rearward thrust water ski 10 is sufficient to provide about 200 lbs of thrust.

In addition to the propulsion structures 20, one or more vanes 22 may mount to the bottom surface of the base 14. The one or more vanes 22 provide stabilization during movement and tend to urge the water ski 10 to move in the longitudinal direction 12*a*. In particular, the vanes 22 may help prevent the rear water ski 10 from moving sideways as the forward water ski 10 is pushed ahead. The vanes 22 may further help keep the skis from spreading too far apart during skiing, standing, or turning.

Figure 1B:
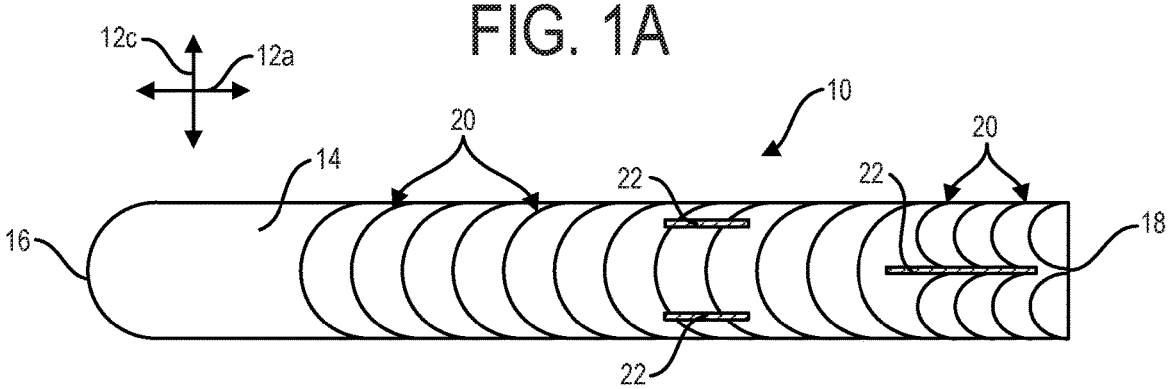
FIG. 1B is a bottom view of the water ski in accordance with an embodiment of the present invention.
Figure 1C:
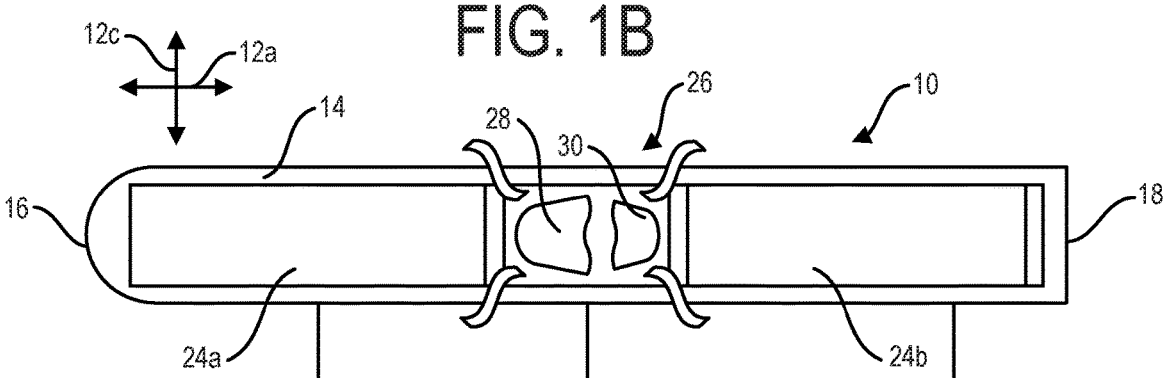
FIG. 1C is a top view of the water ski in accordance with an embodiment of the present invention.

In the illustrated embodiment shown in FIG. 1A and FIG. 1B, there are three vanes 22. Two are positioned behind a binding 26 but spaced forward from the rearward end 18. The binding 26 may include a toe binding 28 sized to receive a toe of a user's foot and a heal binding 30 positioned to engage a heal of the user's foot and urge the foot into the toe binding 28. These two vanes 22 may be aligned with one another along the longitudinal direction 12*a* and separated from one another along the transverse direction 12*c*, such as by at least half the width of the base 14. A third vane 22 is positioned rearward of these and may be centered on the base 14 along the transverse direction 12*c*. This is just one example configuration and any number of vanes may be used. In particular, a single vane 22 may be used, such as at a position rearward of the binding 26 and having sufficient area to provide stabilization without the need for additional vanes 22. In other embodiments, more than three vanes 22 are used and are disposed at various locations on the bottom surface of the water ski 10.

The vanes 22 may be much longer in the longitudinal direction 12*a* than in their thickness transverse direction 12*c*, e.g. greater than 15 times longer than thick. The heights of the vanes may be between 2 and 12 inches, such as between 2 and 10 inches. The height of the vanes 22 in the vertical direction 12*b* may be selected according to a desired degree of stabilization. The length of the forward vanes in longitudinal direction 12*a* likewise may influence the degree of stabilization. In some embodiments, the forward vanes 22 have a height of greater than 4 inches and less than 12 inches and a length of less than 12 inches. The forward vanes 22 may advantageously be positioned no more than two inches along the transverse direction 12*c* from the sides of the water ski 10. The rearward vane 22 may have length up to 15 inches and a height of up to 12 inches in some embodiments. In some embodiments, the rearward vane 22 is positioned less than 18 inches from the rearward end 18 of the water ski 10.

In one example configuration, the rearward vane 22 has a length of 12 inches and a height of 6 inches and is positioned within 4 inches from the rearward end 18 of the water ski 10. In this configuration, the forward vanes 22 have lengths of 6 inches and heights of 4 inches. The forward vanes 22 may be positioned one inch inward from sides of the ski and offset from the tip 16 of the water ski 10 along the longitudinal direction 12*a* by at least 55 to 70 percent of the length of the water ski 10. This is just one example configuration and other combinations of lengths, heights, and positions may also be used.

The vanes 22 may be made of rigid materials such as aluminum, composite (fiberglass, carbon fiber, etc.), plastic, epoxy, metal alloys, or any combination of these materials. The vanes 22 may be secured to the base 14 by means of screws or other fastening means. The base 14 may define a groove for each vane 22 in which the vane 22 seats and is securely fastened.

One or more buoyancy structures 24*a*, 24*b* may be secured to the base 14, such as an upper surface of the planar portion, and possibly the curved portion, of the base 14. In some embodiments, the combined base and buoyancy structures 24*a*, 24*b* have a displacement of at least 36 lbs, i.e. the combined weight of the water ski 10 and any user supported thereby may be at least 36 lbs while still maintaining the upper surfaces of the buoyancy structures 24*a*, 24*b* above the surface of the water. In the illustrated embodiment, there are two buoyancy structures 24*a*, 24*b*. A binding 26 is secured to the base 14 between the buoyancy structures 24*a*, 24*b* such that one buoyancy structure 24*a* is positioned between the binding 26 and the tip 16 and the other buoyancy structure 24*b* is positioned between the binding 26 and the rearward end 18. In this manner, the binding 26 secures to the base 14 below the upper surfaces of the buoyancy structures 24*a*, 24*b*, which may advantageously lower the center of buoyancy of the ski 10. The buoyancy structures 24*a*, 24*b* may be cuboid in shape or may have rounded top surfaces that taper down to the top surface of the base 14.

In some embodiments, the buoyancy structures 24*a*, 24*b* are the same thickness as the base 14, e.g. two inches thick. In others, the buoyancy structures 24*a*, 24*b* are 3 to 4 inches thick for a base 14 that may also be 3 to 4 inches thick. In some embodiments, the buoyancy structures 24*a*, 24*b* are 7 inches wide for a base 14 that is 8 inches wide. The buoyancy structures 24*a*, 24*b* may be embodied as EPS flotation pads secured to the base 14 by means of an adhesive, such as epoxy. Alternatively, the buoyancy structures 24*a*, 24*b* may be embodied as hollow shells. In some embodiments, the buoyancy structures have a length up to 50 inches and a width of up to 17 inches.

In an example configuration, the front buoyancy structure 24*a* is an EPS flotation pad that extends from less than two inches from the tip 16 of the ski to within two inches of the binding 26. For example, the front buoyancy structure 24*a* may be about 16 inches (e.g., +/−2 inches) long. The rear buoyancy structure 24*b* may extend from less than two inches forward of the rearward end 18 to within two inches of the heel binding 30. For example, the rear buoyancy structure 24*b* may be about 34 inches (e.g., +/−2 inches) long. In some embodiments, an opposite arrangement is used, i.e. the front buoyancy structure 24*a* is longer than the rear buoyancy structure 24*b*. In other embodiments, the front buoyancy structure 24*a* provides greater buoyancy than the rear buoyancy structure by having a greater volume due to one or both of a greater length and greater thickness in the vertical direction 12*b*.

Supposing a user of 270 lbs, each water ski 10 would support at least 135 lbs. An example configuration for such a user is two water skis 10 that are 8 feet long and 12 inches wide. The base 14 of such water skis may be two inches thick and include buoyancy structures that are 2 inches thick, 11 inches wide, and 34 inches long. Supposing this configuration and a user of 175 lbs, a single water ski 10 can support at least 75 percent of the weight of the user when the weight of the user is transferred to the rear water ski 10 and the forward water ski 10 is thrust forward.

In another example configuration, the water ski 10 is 8 feet long, 12 inches wide, has a 4 inch thick base 14, and no buoyancy structures 24*a*, 24*b*. In such a configuration, each water ski 10 can displace 166 lbs, which would enable a 232 lbs person to use the water skis 10. It is expected that a thinner base 14, e.g. two inches, would provide improved maneuverability.

The binding 26 may be at an approximate center of the length of the ski 10 along the longitudinal direction 12*a*. The center of the length of the ski 10 may be located forward of the center of the binding 26, such as at least 6 inches forward of the center of the binding 26. In some embodiments, the center of length of the ski 10 is positioned forward of a wearer's center of gravity, e.g. the center of length of the ski may cross through the toe binding 28 or a position forward of the toe binding 28. Stated differently, the binding 26 may be positioned such that the center of buoyancy of the water ski 10 overlaps or is forward of the toe binding 28. Stated in yet another way, the center of buoyancy of the water ski may be forward of the combined center of gravity of the user and the water ski 10 while the user is standing upright with the user's foot in the heel 30 and toe 28 bindings. Since there are two skis 10, one half of the weight of the user may be used to compute the center of gravity of the combined water ski 10 and user. In some embodiments, the binding 26 is arranged such that it is approximately centered (e.g., within 1.5 inches) on the center of gravity of the combined user and water ski 10 and such that the center of the binding 26 is at least 0.5 inches rearward of the center of length of the water ski 10.

The above described positioning of the binding 26 relative to the center of buoyancy, center of gravity, and/or center of length may advantageously encourage the tip 16 of the water ski 10 to be elevated out of the water to help the water ski 10 plane on the surface of the water and reduce the likelihood of ploughing into the water and going under the surface of the water.

The buoyancy structures 24*a*, 24*b* may be of equal or non-equal lengths in the longitudinal direction 12*a*. The buoyancy structures 24*a*, 24*b* may be separate structures bonded to the base 14, e.g. foam blocks. The combined lengths of the buoyancy structures may be between 50 and 90 percent of the length of the water ski 10. One or both of the forward and rearward ends of the buoyancy structures 24*a*, 24*b* may be sloped as shown in FIG. 1A. Likewise, the buoyancy structure 24*a* may be curved in correspondence with the curve leading to the tip 16 of the water ski 10.

Figures 1D, 1E, 1F:
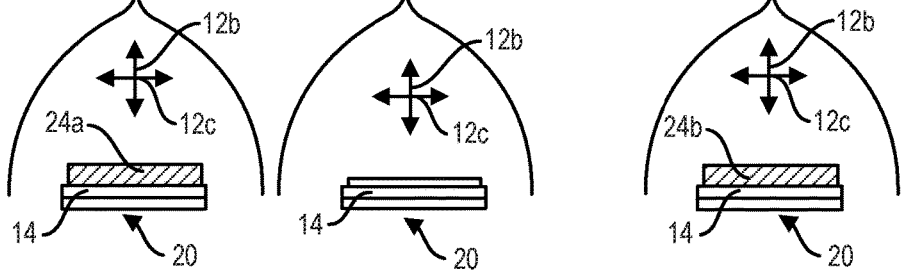
FIGS. 1D, 1E, and 1F are cross-sectional views of the water ski.

As shown in FIGS. 1D and 1F, the buoyancy structures 24*a*, 24*b* may have a thickness in the vertical direction 12*b* substantially equal, e.g., within 5 percent of equal, to the thickness of the base 14 in the planar portion. Alternatively, where additional buoyancy is needed, the buoyancy structures 24*a*, 24*b* may be made thicker. In the illustrated embodiment, the forward buoyancy structure 24*a* narrows in thickness in the vertical direction 12*b* with proximity to the tip 16 and extends over the curved portion and part of the planar portion of the base 14.

In the illustrated embodiment, the widths of the buoyancy structures 24*a*, 24*b* in the transverse direction 12*c* are less than the width of the base 14 such that portions of the base 14 extend outwardly from the buoyancy structures 24*a*, 24*b*.

In some uses, the base 14 may be substantially or completely submerged during use. The buoyancy structures 24*a*, 24*b* may be positioned inwardly from one or both sides of the base 14 to provide less lateral resistance for the ski 10 as it is turned in the water, thereby enabling better maneuverability and a smaller turning radius.

The buoyancy structures 24*a*, 24*b* and base 14 may be a single structure, e.g. a shell having the illustrated shape of the combined base 14 and buoyancy structures 24*a*, 24*b*. The shell may be filled with air or a foam, such as a closed cell foam to provide buoyancy and rigidity. Alternatively, there may be a single buoyancy structure secured to the upper surface of the base without a gap for the binding 26 and the binding 26 may secure to an upper surface of this buoyancy structure. In some embodiments, the buoyancy structures 24*a*, 24*b* are secured to the base 14 and the combination may then be encased in a rigid shell such as a thermoplastic, resin, composite material (fiberglass, carbon fiber, etc.), or other material.

Although one water ski 10 is disclosed and discussed in FIGS. 1A to 1F and in the following figures, it shall be understood that a typical implementation will include two water skis 10 that may be identical or mirrored with respect to one another.

Referring to FIGS. 2A to 2D while continuing to refer to FIG. 1B, there are various shapes and configurations for the propulsion structures 20 that may be used. In the embodiment of FIG. 1B, the propulsion structures 20 have a semicircular shape. The semicircular shape may span substantially all (e.g., at least 90 percent of) the width of the base 14 in the transverse direction 12*c* in the illustrated embodiment but may also be narrower in some embodiments. For example, for an 8 inch wide base, the propulsion structures 20 may have a width of 8 inches. In another example, the propulsion structures have a width of at least one inch less than the width of the water ski 10. For example, a 10 inch wide base 14 may have propulsion structures 20 having a width of 9 inches. The propulsion structures 20 may be separated from one another along the longitudinal direction 12*a*. The separation may be between 0.4 and 0.6 times the width of the propulsion structures in some embodiments, such as 4 inches where the propulsion structures have a width of 8 inches.

The propulsion structures 20 positioned along the rear vane 22 along the longitudinal direction 12*a* may be split into two semicircular structures having the rear vane 22 positioned between them. The splitting of these propulsion structures may promote lateral stability. The combined diameters of each pair of two semicircular propulsion structures 20 may be less than or equal to a value that is the width of the base 14 plus the width of the rearward vane 22. For example, the sum of the diameters of each pair of semicircular propulsion structures 20 may be 7 and ⅞ inches where the rearward vane has a width of ⅛ inch. The separation of the smaller semicircular propulsion structures 20 along the longitudinal directions 12*a* may be the same as or different from the separation between the wider semicircular propulsion structures 20, e.g. 4 inches.

The propulsion structures 20 of FIG. 1B may be semicircular or some other section of a circle, e.g. an arc of less than 180 degrees, such as an arc of as low as 120 degrees in some embodiments.

Figures 2A, 2B, 2C, 2D:
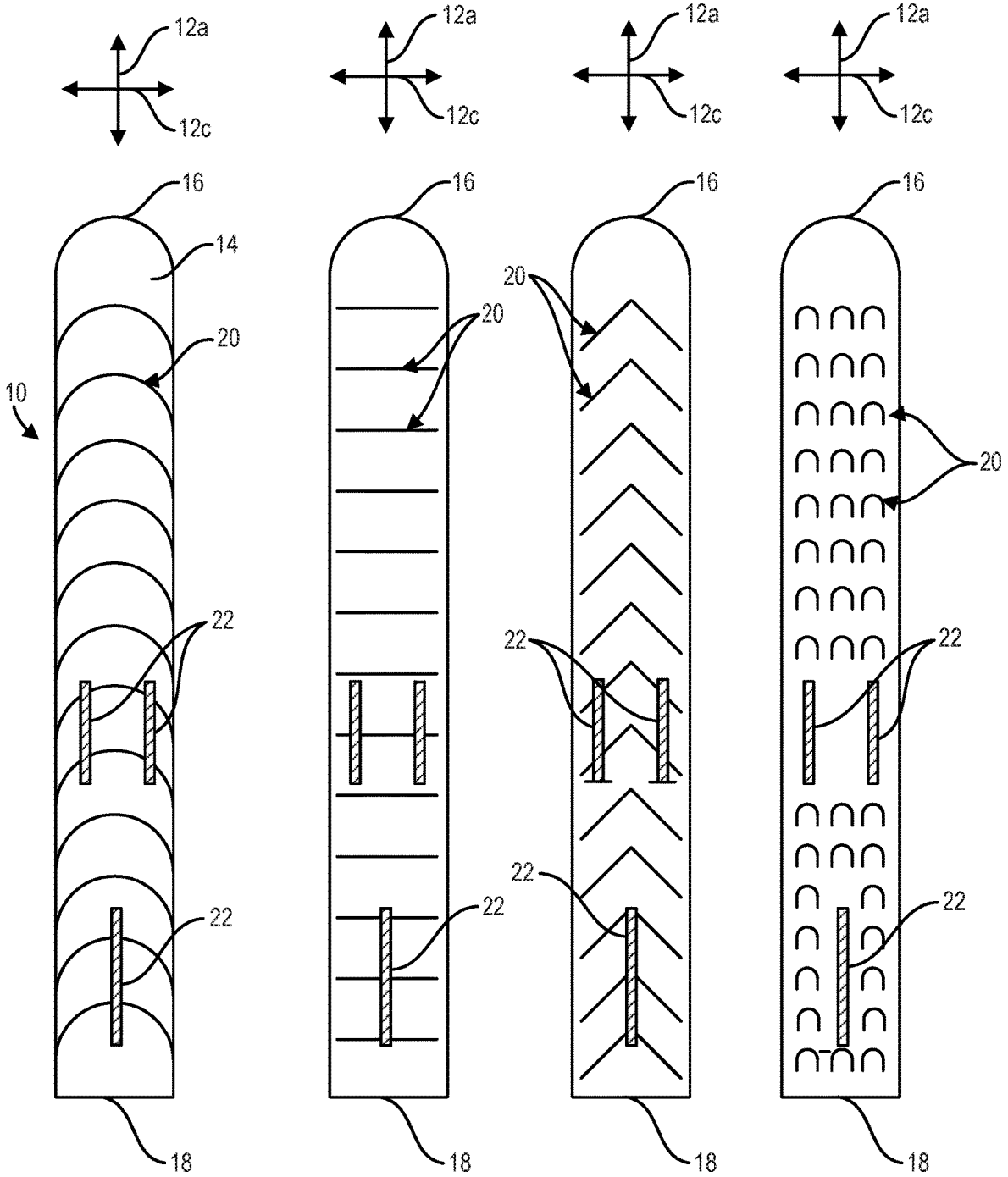
FIGS. 2A, 2B, 2C, and 2D are bottom views showing alternative implementations for the bottom of the water ski.

In the embodiment of FIG. 2A, the propulsion structures 20 have an arcuate shape spanning the width of the base 14 or being narrower than the base 14. In the embodiment of FIG. 2A, the propulsion structures 20 in the longitudinal region including the rear vane 22 are not split into two semicircles. As for the embodiment of FIG. 1B, the semicircular shapes may be arcs of 120 to 180 degrees, with the illustrated embodiment including 180 degree arcs, i.e. semicircular arcs.

In the embodiment of FIG. 2B, the propulsion structures 20 are straight and oriented parallel to the transverse direction 12*c*. The propulsion structures of FIG. 2B may span all or part (e.g., 80 to 100 percent) of the width of the water ski 10.

In the embodiment of FIG. 2C, the propulsion structures 20 secured to the base 14 are 'V' or chevron shaped with the point of the V pointed forwardly and the legs of the V extending rearwardly and outwardly from the point. In the illustrated embodiment, the legs of the V define an angle of about 90 degrees, e.g. 85 to 95 degrees. However, other angles are possible, such as from 70 to 120 degrees. The V of each propulsion structure 20 may be symmetrical about a line extending along the base 14 along the longitudinal direction 12*a* and centered on the base along the transverse direction 12*c*. The V of each propulsion structure may span all or part (e.g., 80 to 100 percent) of the width of the water ski 10.

In the embodiment of FIG. 2D the propulsion structures 20 secured to the base 14 are embodied as discrete scales that individually span only a portion of the width of the water ski 10 but that are arranged in rows that span all or part (e.g., 80 to 100 percent) of the width of the water ski 10. In other embodiments, the propulsion structures 20 embodied as scales are arranged in a staggered (overlapping in the longitudinal direction 12*a*) configuration. For example, the illustrated embodiment shows U-shaped scales arranged in rows of three scales, with rows of scales distributed along the length of the base 14. The scales may have other shapes, such as the shapes of the propulsion structures of FIG. 2A, 2B, or 2C that are reduced in size such that three or more may fit in a row within the width of the base 14. In some embodiments, there may be up to 2000 propulsion structures 20 embodied as the scales of FIG. 2D.

Figure 3A:
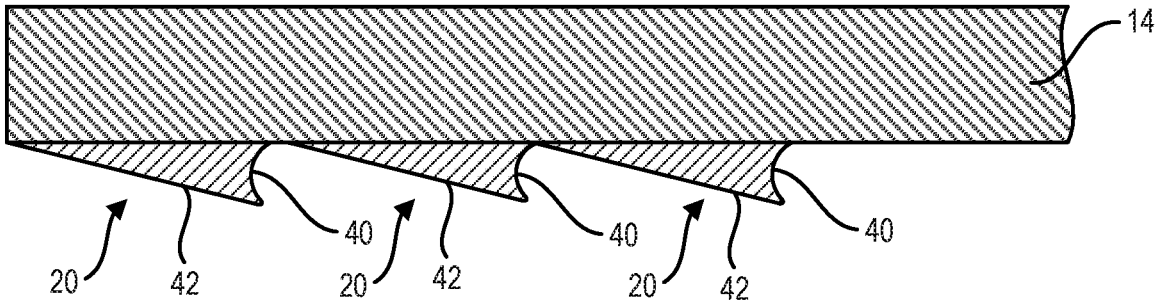
FIG. 3A is a side cross-sectional view showing detail of a first embodiment of a propulsion structure in accordance with an embodiment of the present invention.
Figure 3B:
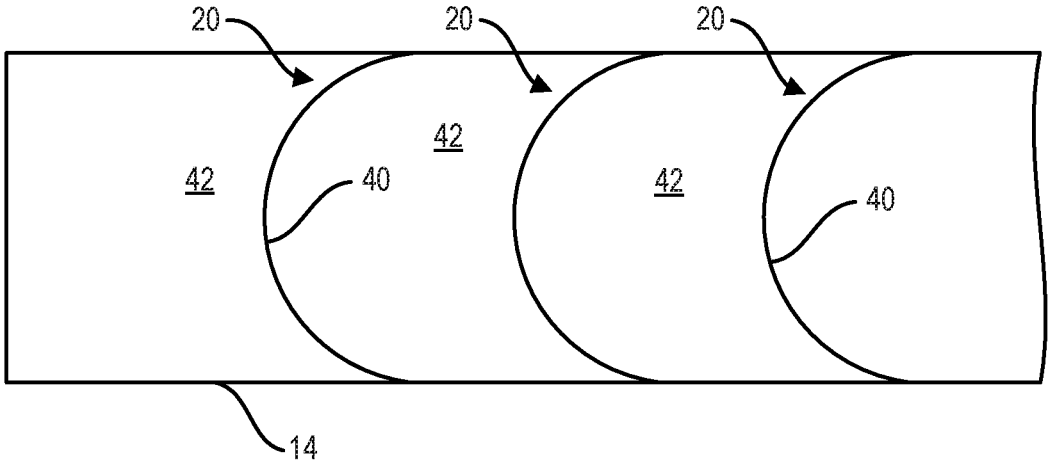
FIG. 3B is a bottom view of the first embodiment of the propulsion structure in accordance with an embodiment of the present invention.
Figure 3C:
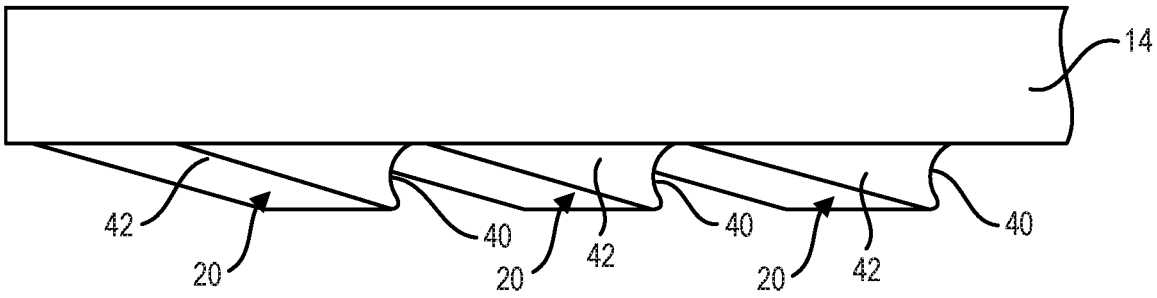
FIG. 3C is a side view of the first embodiment of the propulsion structure in accordance with an embodiment of the present invention.

FIG. 3A illustrates a center cross-sectional view of an example embodiment of a propulsion structure 20 embodied as a semicircle, arc, or U-shape. FIG. 3B is a bottom view of the example embodiment and FIG. 3C is a side view of the example embodiment. The features of the illustrated embodiment may be used for one or both of the full width propulsion structures 20 and the partial-width propulsion structures 20 along the rearward vane 22 as shown in the embodiment of FIG. 1B.

The propulsion structure 20 may include a propulsion surface 40. The propulsion surface 40 may have the shape in a plane parallel to the longitudinal direction 12*a* and transverse direction 12*c* (the longitudinal-transverse plane) as described above for the propulsion structure 40, i.e. a concave shape such as a semicircle, arc, or U-shape. In the illustrated embodiment, the propulsion surface 40 is contoured, such as the illustrated concave shape. In particular, the top and/or bottom edges of the propulsion surface 40 may have the specified shape (semicircle, arc, U-shape, chevron, etc.) but the surfaces between the top and bottom edges may be non-planar. In some embodiments, the top edge of the propulsion surface 40 is one inch below the bottom surface of the base 14 along the vertical direction 12*b*. In some embodiments, the top edge of the propulsion surface 40 projects from 0.5 to 4 inches below the bottom surface of the base 14. In the illustrated embodiment, the propulsion surface 40 may conform to a portion of a toroidal shape.

The top edge of the propulsion surface 40 may be connected to the bottom surface of the base 14. A sloped surface 42 extends forwardly (toward the tip 16) from the bottom edge of the propulsion surface 40 and slopes upwardly toward the base 14 such that a separation between the sloped surface 42 and the base 14 becomes narrower with distance from the propulsion surface 40. Stated differently, the cross section of the propulsion structure 30 in planes parallel to the longitudinal direction 12*a* and vertical direction 12*b* (longitudinal-vertical plane) may be wedge shaped with the wide end of the wedge being at the propulsion surface 40 and the narrow end of the wedge positioned forwardly of the propulsion surface 40. The slope of the surface 42 may be less than or equal to 60 degrees in some embodiments. In the illustrated embodiment, the sloped surface 42 ends at the bottom edge of the next propulsion surface 40 of the next propulsion structure 20 moving in the forward direction, except for the forwardmost propulsion structure 20 which may taper to zero thickness or some other non-zero thickness. Various separation distances along the longitudinal direction 12*a* between propulsion surfaces 40 may be used, such as one foot for 8 inch wide arcs or 4 inches for the scales of FIG. 2D.

Edges and points defined at the joining of the propulsion surface 40 with the sloped surface 40 may be rounded or smooth in order to reduce potential for harm to a user. For example, edges and/or points may be rounded to a radius of 0.5 to 1 inch. This may be the case for all embodiments of the propulsion structures 20 described herein.

Figure 4A:
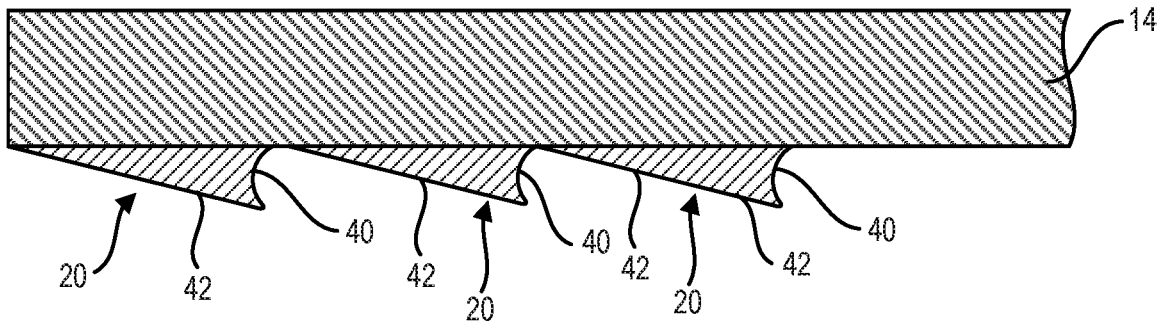
FIG. 4A is a side cross-sectional view showing detail of a second embodiment of a propulsion structure in accordance with an embodiment of the present invention.
Figure 4B:
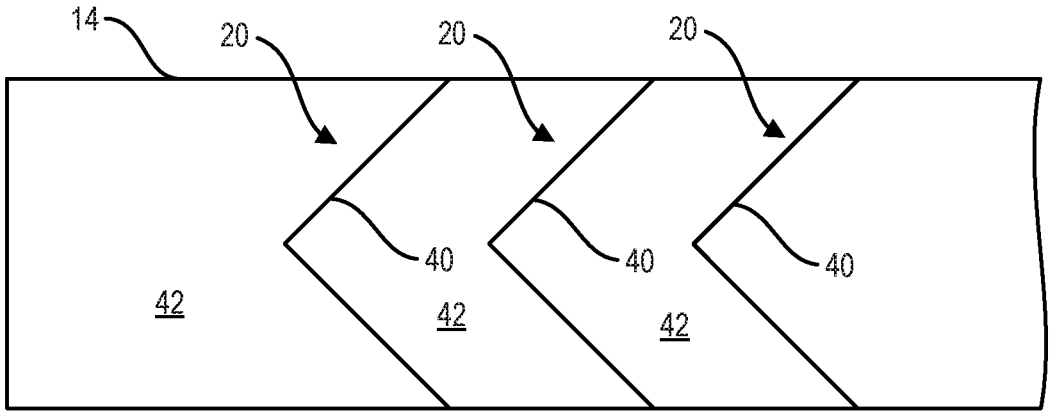
FIG. 4B is a bottom view of the second embodiment of the propulsion structure in accordance with an embodiment of the present invention.
Figure 4C:
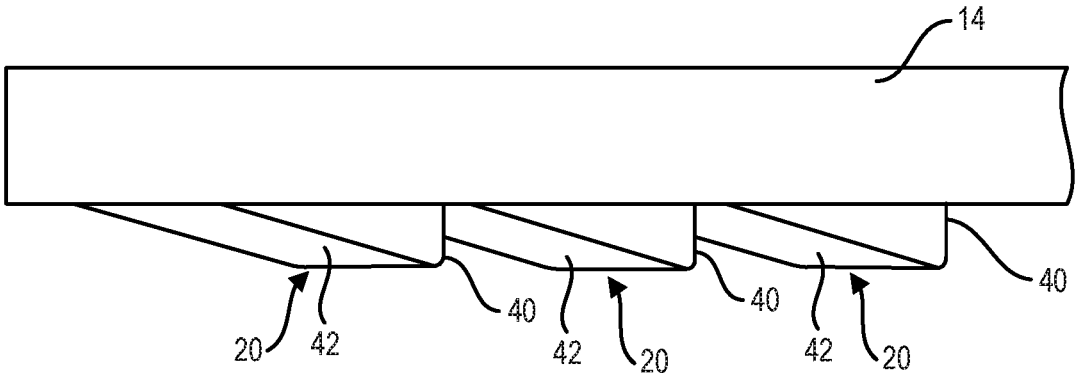
FIG. 4C is a side view of the second embodiment of the propulsion structure in accordance with an embodiment of the present invention.

FIG. 4A is a center cross-sectional view of an example embodiment of a V-shaped propulsion structure 20. FIG. 4B is a bottom view of the example embodiment of FIG. 4A and FIG. 4C is a side view of the example embodiment of FIG. 4A. In this embodiment, the propulsion surface 40 may be V-shaped in the longitudinal-transverse plane. Again, the propulsion surface 40 may have a concave shape, such as groove conforming to cylinder along the legs of the V shape, though other concave shapes may be used. The sloped surface 42 may be configured similarly to the embodiment of FIGS. 3A to 3C. For example, the sloped surface 42 may extend from the bottom edge of the V-shape to a point forward therefrom such that the cross-section of the sloped surface 42 in longitudinal-vertical planes has a wedge shape. The bottom edge of the propulsion surface 40 may be from 0.5 to 4 inches from the bottom surface of the base 14 in some embodiments. Likewise, the separation between the propulsion surfaces 40 may be 12 inches for an 8 inch wide ski in some embodiments. For smaller V-shaped scales, the separation may be less than 4 inches in some embodiments.

Figure 5A:
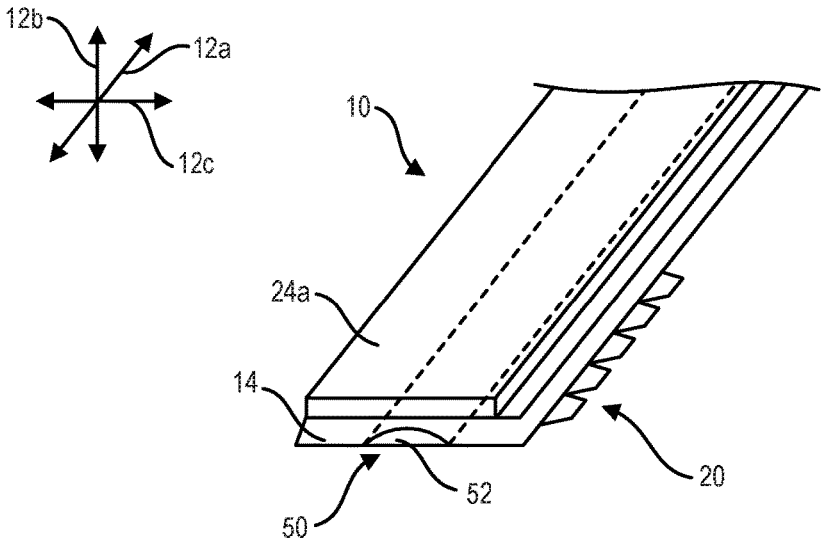
FIG. 5A is an isometric view showing a third embodiment of the propulsion structure in accordance with an embodiment of the present invention.
Figure 5B:
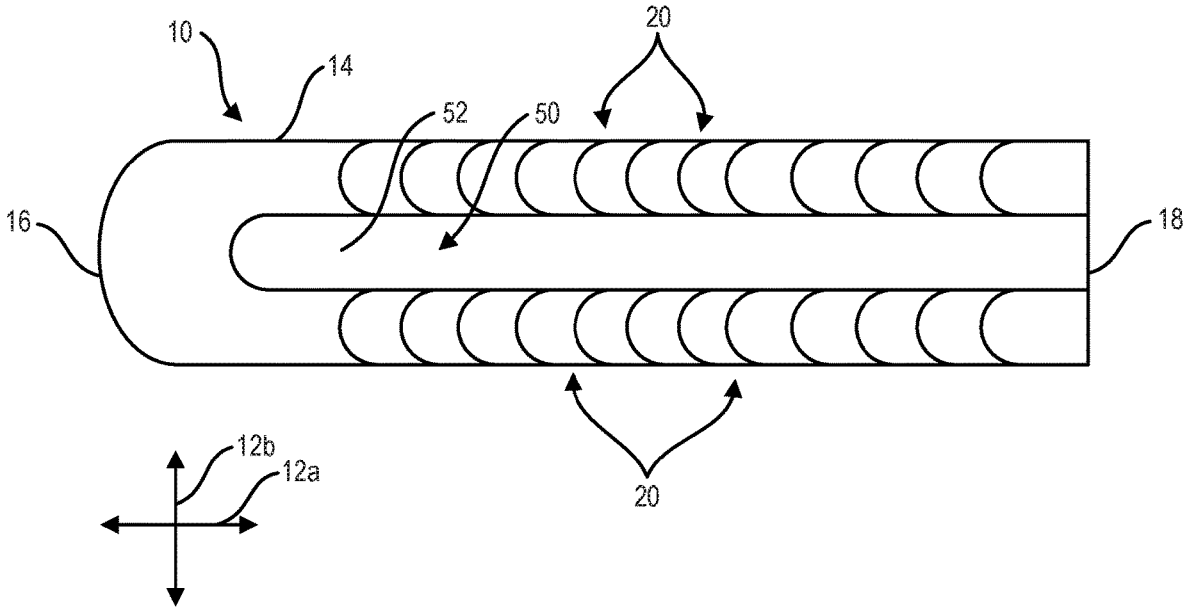
FIG. 5B is a bottom view of the third embodiment of the propulsion structure in accordance with an embodiment of the present invention.

FIG. 5A is an isometric view and FIG. 5B is a bottom view of an alternative embodiment. In this embodiment, the propulsion structures 20 include two rows of propulsion structures 20 distributed along the longitudinal direction 12*a*. The rows of propulsion structures 20 may be arranged on either side of channel 50. The channel 50 may be defined by the propulsion structures 20 themselves, i.e. a region defined in the middle of the base 14 and having a width in the transverse direction 12*c* such that no propulsion structures 20 are positioned in that region along the entire length of the base 14. The channel 50 may additionally or alternatively include a groove 52 defined in the base 14 and that extends along the longitudinal direction 12*a* in the region 50. The channel 50 resists movement of the water ski 10 along the transverse direction 12*c*. Accordingly, vanes 20 may be omitted in the embodiment of FIGS. 5A and 5B. The propulsion structures 20 of the rows of propulsion structures 20 may have the shape and features (semicircle, arc, U, chevron) according to any of the embodiments disclosed herein. In the illustrated embodiment, the propulsion structures are semicircles and may have the features as shown in FIGS. 3A to 3C.

In one example, the channel 50 has a width of 3 inches for a water ski that is 8 inches wide. The groove 52 may be 0.5 inches deep and arcuate in shape in the vertical-transverse plane. In some embodiments, the channel 50 may extend from a point rearward of the tip 16 to the rearward end 18 of the water ski 10, such as at least 18 inches from the tip 16 for an 8 foot long and 12 inch wide ski. In one example, the semicircular propulsion structures in the embodiment of FIGS. 5A and 5B have diameters of 4 inches.

Note that in some embodiments, vanes 22 are omitted and the propulsion structures 20 are arranged in an opposite configuration to that shown in FIGS. 5A and 5B: the propulsion structures may occupy a fraction, e.g. 0.55 to 0.45 times, of the width of the water ski 10 in the transverse direction 12*c* and centered on the water ski 10 in the transverse direction 12*c*. In this manner, the propulsion structures function to provide propulsion and lateral stability. In such embodiments, the propulsion structures 20 may have any of the shapes (semicircular, arc, V, U, etc.) described herein.

In the embodiments of FIGS. 1A to 5B, various embodiments of propulsion structures 20 are shown. In some embodiments, a single base 14 of a single water ski may include propulsion structures 20 corresponding to multiple embodiments, e.g. two or more of semicircular arcs, chevrons, and scales.

Figure 6:
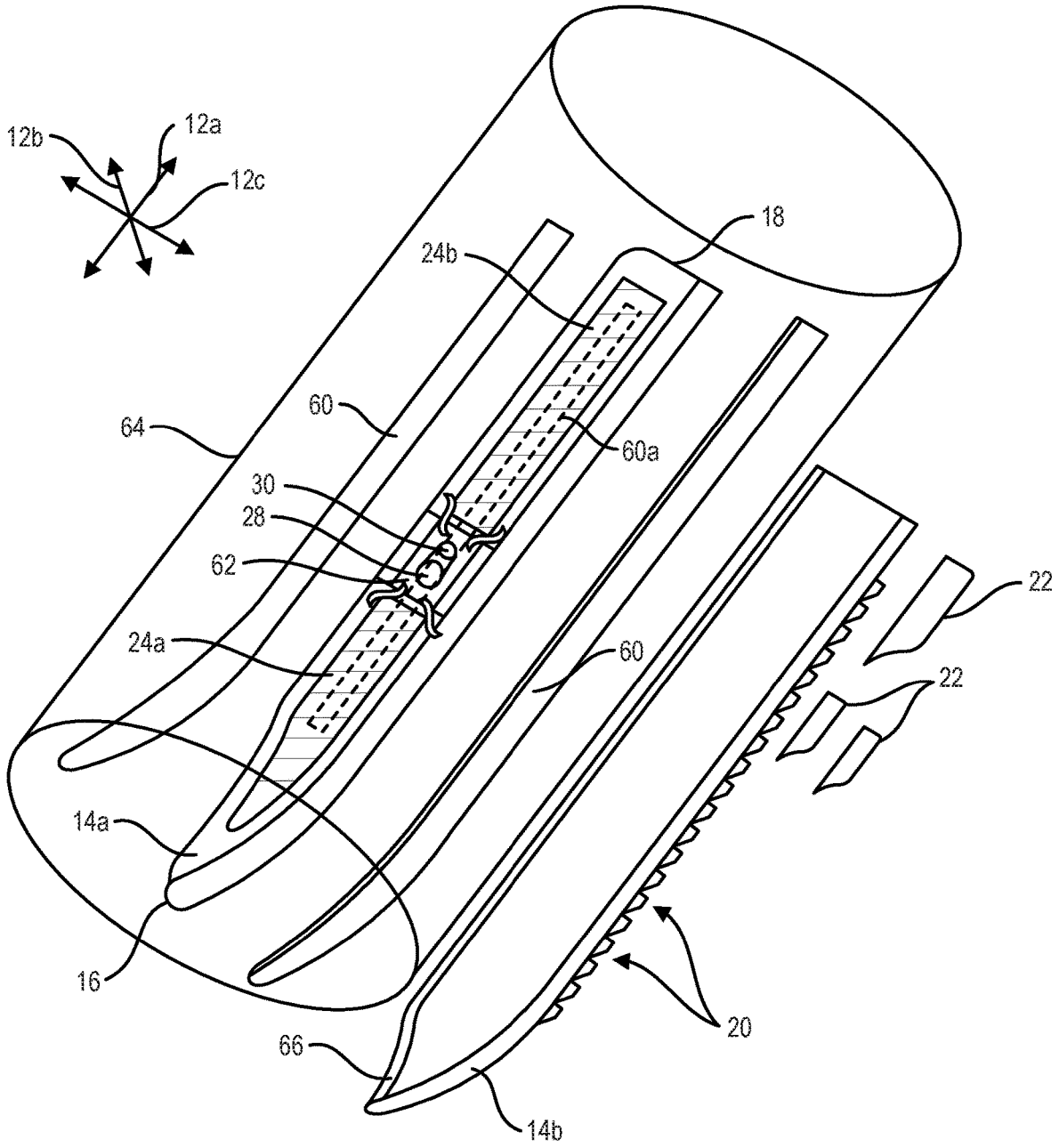
FIG. 6 is a disassembled view of a water ski in accordance with an embodiment of the present invention.

FIG. 6 illustrates an example method of construction of the water ski 10. In the illustrated embodiment, the base 14 includes a top layer 14*a* and a bottom layer 14*b*, each of which may have the shape of the base 14 as described above, e.g., a tapered and curved portion near the tip 16 and flat rearward of the curved portion. The bottom layer 14*b* may have the propulsion structures 20 mounted to the bottom surface thereof and the top layer 14*a* may have the binding 26 and buoyancy structures 24*a*, 24*b* mounted thereto as described above. The bottom surface of the top layer 14*a* may be bonded to the top surface of the bottom layer 14*b* by means of adhesive, fasteners, welding, or other means.

In some embodiments, vertical supports 60 are secured to the top layer 14*a* along the edges thereof, i.e. the edges on the left and right sides that are substantially (e.g., within 5 degrees of) parallel to the vertical direction 12*b*. The vertical supports may be taller in the vertical direction 12*b* than in the transverse direction 12*c*, e.g., 50 to 250 times and provide resistance to bending of the water ski in the longitudinal-vertical plane. For example, in some embodiments, the vertical support is 10 mil wide and 2 inches high (i.e., the height of the base 14 in the planar portion).

The vertical supports 60 may be made of a stronger material, e.g. higher modulus of elasticity, ultimate strength, etc., than the material used to form the top layer 14*a*. For example, the vertical supports 60 may be made of a rigid plastic, wood, metal, composite material, or other material. The height of the vertical supports 60 may be equal to or less than the height of the layer 14*a*. As is apparent in FIG. 6, the vertical supports may be tapered and upward curving to conform to any tapering and upward curving of the top layer 14*a*. The vertical supports 60 may be secured to edges of the top layer 14*a* by means of adhesive (e.g., epoxy), fastening, welding, or some other fastening means. One or more additional vertical supports 60 may be used. For example, an additional central vertical support 60*a* may be embedded in the base 14 substantially (e.g., within 1 inch) centered along the transverse direction 12*c* and extending along substantially all (e.g., at least 80 percent) of the length of the water ski in the longitudinal direction 12*a*. The width-height ratio of the central vertical support 60*a* may be in the same range as for the vertical support 60 described above. For example, the central vertical support 60*a* may have a height of 0.5 inches and a width of 1/16 inches in order to reduce buckling of the water ski 10.

The buoyancy structures 24*a*, 24*b* may also be secured to the upper surface of the top layer 14*a*, 14*b* as described above. A plate 62 may be secured to the top layer 14*a* in order to receive fasteners securing the binding 26 to the top layer 14*a*. The plate 62 may be made of metal, wood, rigid plastic, composite material, or other material having sufficient strength to receive the fasteners. For example, in some embodiments, the plate 62 may be a 0.25 inch plywood plate adhered to the top layer 14*a*. The plate 62 may have the opening for receiving the fasteners formed therein prior to securing to the top layer 14*a*. In some embodiments, rather than a single plate 62, a plurality of separate plates 62 or other reinforcing structures are placed in order to receive the fasteners.

The combination of the top layer 14*a*, vertical supports 60, buoyancy structures 24*a*, 24*b*, and plate 62 may be covered with an outer shell 64 shown schematically as a surrounding layer in FIG. 6. Following application, the outer shell 64 may be a layer of composite material (fiberglass, carbon fiber), thermoplastic, resin, or other material forming a rigid shell and conforming to the shape of the components encased in it. For example, the shell 64 may be formed of two layers of four ounce HEXEL fiberglass. Note that in some embodiments, the plate 62 is adhered to the shell 64 after formation rather than being positioned within the shell 64.

The shell 64 having the top layer 14*a* and some or all of the supports 60, buoyancy structures 24*a*, 24*b*, and the plate 62 encased therein may be bonded to the bottom layer 14*b*. In some embodiments, the bottom layer 14*b* defines a recess for receiving the shell 64. The bottom layer 14*b* may be wider than the top layer 14*a* in order to receive the top layer 14*a*. For example, the bottom layer 14*b* may be 8.125 inches wide as compared to the top layer that is 8 inches wide. For example, a ridge 66 may extend around the perimeter of the bottom layer 14*b* and be sized to receive the shell 64. The ridge 66 may have a height substantially (e.g., within 10 percent of) equal to the thickness of the top layer 14*a*, which is two inches in some of the above-described embodiments. The ridge 66 may provide additional stiffness to the water ski. The shell 64 may be secured to the bottom layer 14*b* within the recess defined in the bottom layer 14*b* by means of adhesive, such as epoxy.

In embodiments including vanes 22, these vanes 22 may be secured to the bottom surface of the bottom layer 14*b* in the positions described above. Securement may be performed before or after the bottom layer 14*b* is secured to the shell 64. In some embodiments, vanes 22 are secured to the bottom layer 14*b* by means of screws. Alternatively, the vanes 22 may be secured to the bottom layer 14*b* in the same process that secures the propulsion structures 20 to the bottom layer 14*b*, which may include co-molding of the bottom layer 14*b* with the propulsion structures 20 and the vanes 22.

Figure 7:
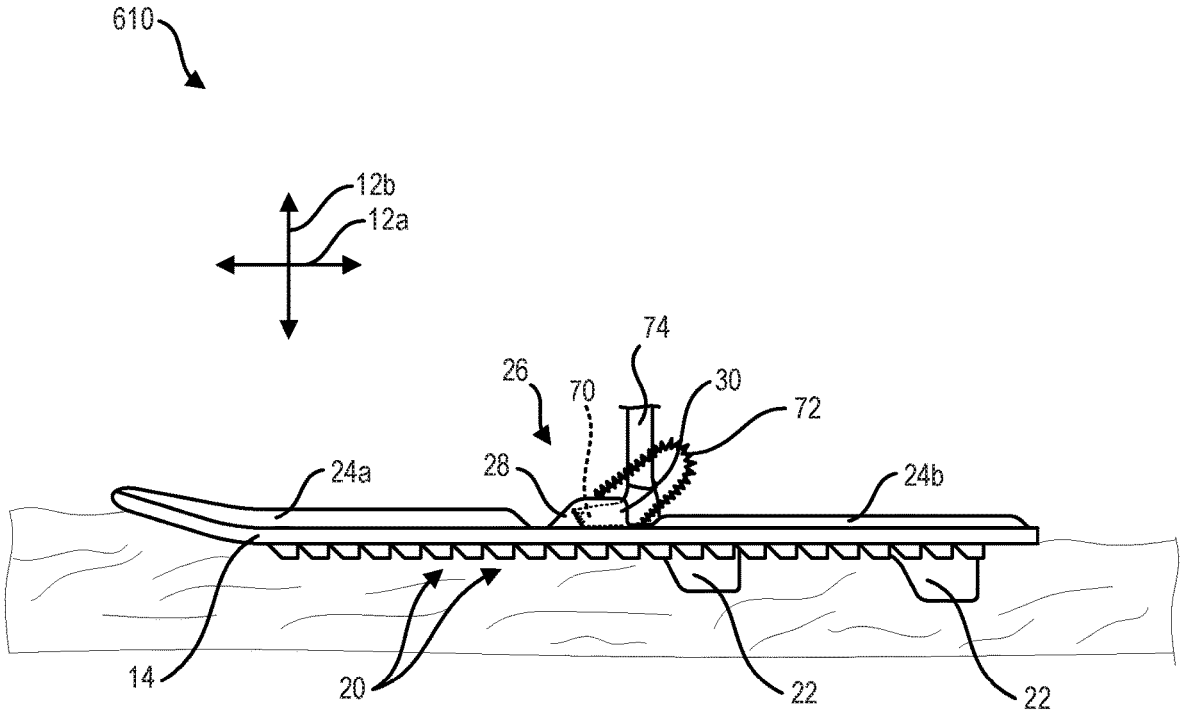
FIG. 7 is a side view illustrating a foot in the binding of the water ski in accordance with an embodiment of the present invention.

Referring to FIG. 7, in use, the user places a foot 70 with the toe of the foot 70 in the toe binding 28 and the heel in the heel binding 30. A leash 72 may secure to the water ski 10 and be fastened to the leg 74 of the user as a precaution against the skis drifting away from the skier if the skis come off after a fall. The leash 72 may be implemented according to any approach for implementing a leash as known in the art of surf boards, stand-up paddle boards, or the like.

Figure 8:
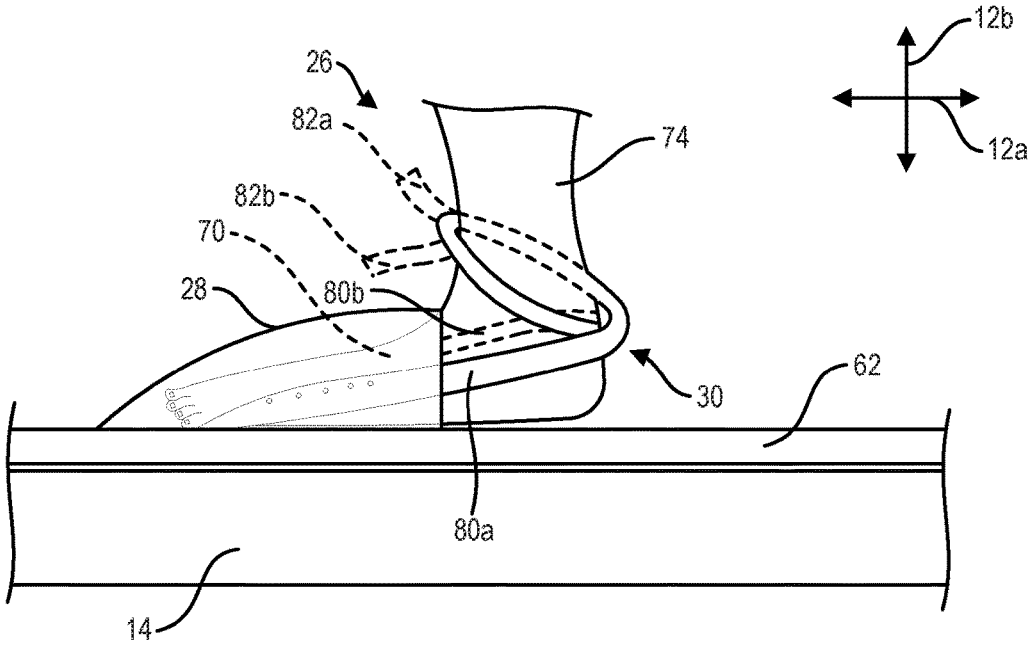
FIG. 8 is a side view illustrating a binding for the water ski in accordance with an embodiment of the present invention.

FIG. 8 illustrates an example embodiment of a heel binding 30 embodied as a heel lift binding 30. The heel lift binding 30 may advantageously enable the user to exert a rearward force on the water ski 10 when the opposite water ski 10 is being thrust forward. The illustrated heel lift binding 30 may further enable the user's heel to lift away from the base 14 while remaining engaged in the heel lift binding 30 in order to permit more natural striding motion and reducing ankle strain. In some embodiments, the heel lift binding 30 may be embodied as a first strap 80*a* secured at a left side of the toe binding 28 and a second strap 80*b* secured at a right side of the toe binding 28 opposite the left side. In some embodiments, the straps 80*a*, 80*b* secure to the base 14 spaced inwardly along the transverse direction 12*c* from edges of the base 14 by at least 0.5 inches. The straps 80*a*, 80*b* may be secured to the toe binding 28 or to the base 14 offset rearward of the toe binding 28, such as up to two inches rearward of the toe binding 28 such that the foot 70 of the user is positioned between points of attachment of the straps 80*a*, 80*b* during use. The straps 80*a*, 80*b* may be embodied as a soft rubber, neoprene, or similar material in order to promote comfort of the wearer and to provide a degree of elasticity. In some embodiments, the straps 80*a*, 80*b* are one inch wide. The toe binding 28 may likewise be made of soft rubber, neoprene, or similar material.

Each strap includes a fastener portion 82*a*, 82*b*, respectively that may be engaged with one another. The fastener portions 82*a*, 82*b* may include different portions of a buckle, e.g. different parts of a side-release buckle, hook portions and loop portions of a hook-and-loop fastening system (e.g., Velcro), a buckle and a series of holes for engaging the buckle (e.g., a belt buckle), ratchet and toothed strap, or any other type of fastening system known in the art. The fastener portions 82*a*, 82*b* may be securable to one another at various positions thereby enabling a user to adjust the tension of the straps 80*a*, 80*b* on the user's foot.

As is apparent in FIG. 8, the straps 80*a*, 80*b* are wrapped around the ankle and heel of the foot 70 and brought around to the front of the ankle of the user. The fastener portions 82*a*, 82*b* are then engaged with one another in order to secure the user's foot 70 in the binding 26. The straps 80*a*, 80*b* may be tensioned prior to securement of the fastener portions 82*a*, 82*b* such that elasticity of the straps 80*a*, 80*b* urges the user's foot 70 into the toe binding 28. The fastening strength of the fastener portions 82*a*, 82*b* may be such that for a degree of force exerted by a user falling relative to the skis 10 will be sufficient to release the fastener portions 82*a*, 82*b* and detach from the water ski. Alternatively or additionally, the straps 80*a*, 80*b* may have sufficient elasticity to allow the user's foot 70 to pull out of the binding 26 in the event of a fall.

The embodiment of FIGS. 7 and 8 is just one example of a binding 26. In other embodiments, both the toe binding 28 and heel binding 30 are affixed to the base (see, e.g., FIGS. 1A, 1C, and 6). Such a binding may be according to any approach known in the art of water skis, such as water skis worn by a person being towed behind a boat. In another alternative, the heel lift binding 30 may be embodied as a single strap 80*a* secured at one side, e.g., left, of the toe binding 28 that is wrapped around the skier's ankle for a full turn and then secured to the other side, e.g., right, of the toe binding 28 with hook-and-loop fasteners (VELCRO), buckles, or other type of fastener.

Figure 9A:
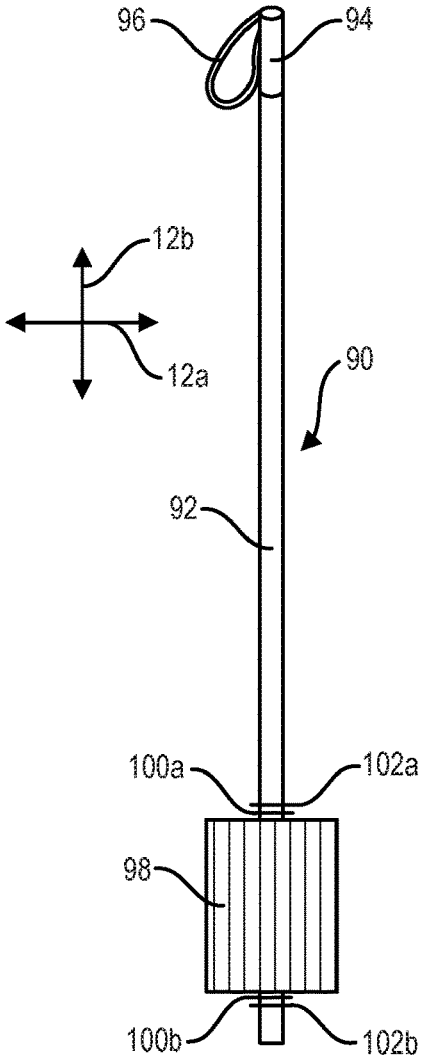
FIG. 9A is a front view of a water ski pole in accordance with an embodiment of the present invention.
Figure 9B:
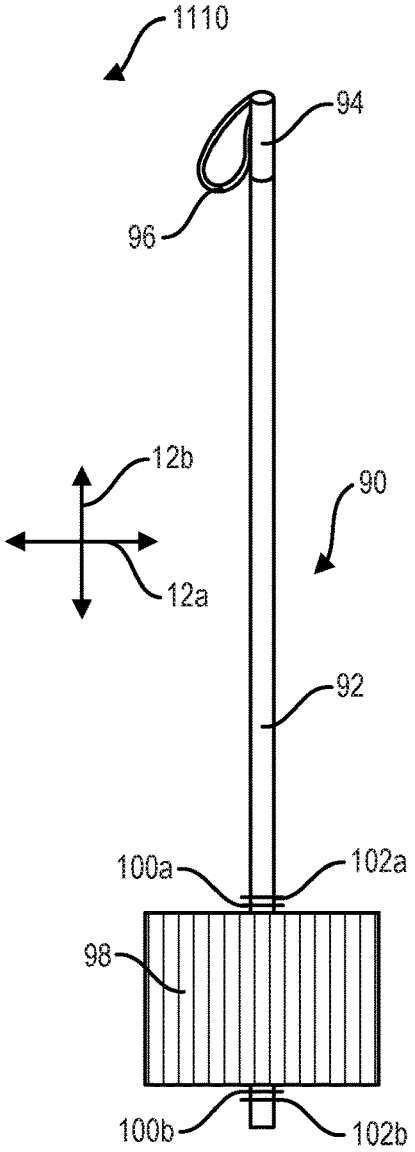
FIG. 9B is a side view of the water ski pole of FIG. 9A in accordance with an embodiment of the present invention.
Figure 9C:
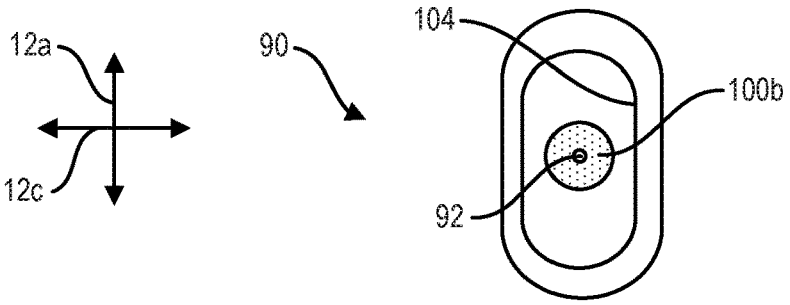
FIG. 9C is a bottom view of the water ski pole of FIG. 9A in accordance with an embodiment of the present invention.

FIG. 9A is a front view of an example embodiment of a water ski pole 90. FIG. 9B is a side view of the water ski pole 90. FIG. 9C is a bottom view of the water ski pole 90. The water ski pole 90 may include a rod 92, such as a cylindrical rod 92. The rod 92 may be hollow, such as hollow plastic, and may be sealed such that it is buoyant. The rod 92 may be filled with a closed cell foam, such as expanded polyethylene (EPE) foam, that is buoyant or may be made of a plastic that is buoyant. In other embodiments, buoyancy of the rod 92 itself is not achieved. A top end of the rod 92 may have a handle 94 secured thereto. In some embodiments, a tether 96 for securing the water ski pole 90 to the wrist of the user may also be secured to the handle 94 or directly to the top end of the rod 92. The tether 96 may be formed of neoprene or other suitable material.

A float 98 secures to the bottom end of the rod 92, such as within 4 inches from the bottom end of the rod 92. The float 98 may be made of a buoyant foam, such as EPS, EPE, or other foam. In other embodiments, the float 98 includes an inflated bladder. In the illustrated embodiments, the rod 92 passes through an upper plate 100*a*, through the float 98, and through a lower plate 100*b*. The plates 100*a*, 100*b* may function to distribute forces from the rod 92 to the float 98 inasmuch as the float 98 may be made of foam and therefore be subject to tearing. In the illustrated embodiment, a cotter pin 102*a* engages the rod 92 above the plate 100*a* and a second cotter pin 102*b* engages the rod 92 below the plate 100*b* in order to retain the plates 100*a*, 100*b* on either side of the float 98.

In some embodiments, the float 98 has an elliptical or oval cylinder shape with the long axis of the elliptical or oval shape being oriented parallel to the longitudinal direction 12*a* (i.e., a longitudinal direction locally defined for the water ski pole 90). For example, an ellipse with a length-to-width ratio of less than 10:1. In use, the longitudinal direction 12*a* of the water ski pole will be generally (e.g., within 20 degrees of) parallel to the longitudinal direction 12*a* of the water ski 10. Other shapes such as cuboid, spherical, circular cylinder, or a combination of any of these shapes may be used. In some embodiments, the float 98 has a length of up to 18 inches, a width of up to 15 inches, and a height of up to 12 inches.

In one example configuration, the water ski pole 90 is 6 feet long, has an elliptical float 98 of 2:1 length-to-width ratio that is 12 inches long, 6 inches wide, and 8 inches high. In this configuration, the float 98 has a displacement of 576 cubic inches and a displacement of 20.8 lbs. This provides about 20 lbs. of buoyancy available to help stabilize the user when the float 98 is pushed under the surface of the water.

In some embodiments, a lower surface of the float 98 may define a recess 104, e.g. a hollow area surrounded by a ridge of material of the float 98. This recess 104 may promote the creation of hydrodynamic drag on the float 98 to prevent the float 98 from moving rearward when used for forward propulsion. For example, the recess 104 may conform to an elliptical cylinder and have a depth of 0.25 to 0.5 inches in some embodiments. In some embodiments, the recess 104 only extends to within one inch from the edge of the float 98.

For example, suppose there is a float that is 12 inches long, 6 inches wide, and 8 inches high with an elliptical recess 104 having a depth of 0.25 inches, width of 4 inches, and length of 10 inches. The volume of the recess 104 is 31 cubic inches such that the total displacement of the float 98 is 545 cubic inches, which gives a displacement of 19.6 lbs. in water. It is therefore apparent that a recess 104 may be used without significantly compromising the displacement of the float 98.

In other embodiments, arcs, ridges, or other protrusions extending from the bottom surface of the float 98 may be used to increase hydrodynamic drag for use in propulsion. For example, propulsion structures 20 according to any of the embodiments described herein may be formed on the bottom surface of the float 98. These propulsion structures 20 may be scaled smaller due to the smaller size of the float 98. For example, 0.25 inch high arcs with rearward facing concave surfaces with 4 inch diameters spaced apart by 4 inches in the longitudinal direction 12*a* of the water ski pole 90.

In use, the user may thrust downwardly and rearwardly with the water ski pole 90, thereby urging the float 98 into the water and providing a stabilizing force up to the amount of displacement of the float 98 and a resultant forward thrust on the user to facilitate propelling of the user and water skis 10 forward in combination with the differential in hydrodynamic drag provided by the propulsion structures 20 on the water skis 10.

Figure 10:
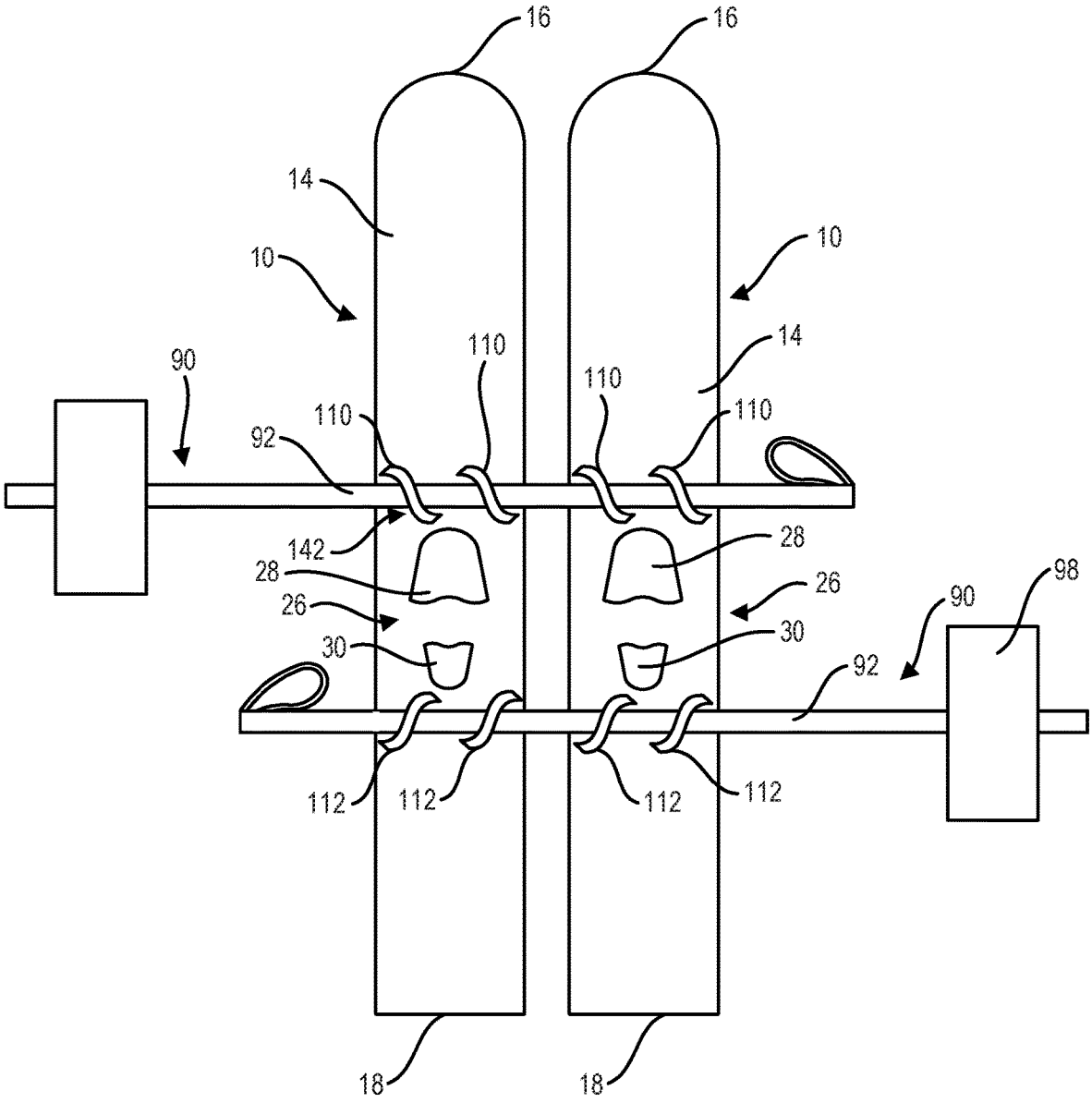
FIG. 10 is a top view showing fastening of water ski poles to water skis in accordance with an embodiment of the present invention.

Referring to FIG. 10, in some embodiments, one or more straps 110 are secured to each water ski 10 in front of the toe binding 28, e.g. between the toe binding 28 and the front buoyancy structure 24*a*. One or more straps 112 secure to each water ski 10 behind the heel binding 30, e.g. between the heel finding 30 and the buoyancy structure 24*b*. In some embodiments, the straps 110, 112 are one inch wide, though other widths may be used. The straps 110, 112 may be made of nylon or other material. The straps 110, 112 may include fastening structures, such as hook-and-loop fastening structures, snaps, buckles, or other fastening structures such that the straps 110, 112 may be looped around the rod 92 of a water ski pole 90 in the illustrated manner and secured around the rod 92 using the fastening structures. In some embodiments, the straps 110, 112 are each six inches long and have two inch hook-and-loop fasteners (e.g., VELCRO) at the end thereof. The straps 110, 112 may be secured to the base 14 by means of screws or other fasteners.

In the illustrated embodiment, there are two straps 110 and two straps 112 in order to provide additional holding strength and to resist rotation of the water skis 10 about an axis parallel to the longitudinal direction 12*a*. In particular, the two straps 110 may be offset from one another along the transverse direction 12*c* by an amount equal to at least half the width of the water ski 10. Likewise, the two straps 112 may be offset from one another along the transverse direction 12*c* by an amount equal to at least half the width of the water ski 10. For example, the straps 110, 112 may be secured to the base 14 less than one inch from the edges of the base 14.

As shown, the straps 110 of two water skis 10 are fastened to the rod 92 of one propulsion structure 90. The straps 112 of the two water skis 10 are fastened to the rod 92 of a second propulsion structure 90. The floats 98 of the two water ski poles 90 may be positioned on opposite sides of the pair of water skis 10 and therefore function as stabilizing outriggers. In this manner, while a user is boarding the water skis 10 and fastening the user's feet to the bindings 26, the water skis 10 and water ski poles 90 provide a stable platform. This enhances user safety in contrast to trying to board the water skis 10 when detached from one another and therefore more susceptible to tipping. The user may then detach the water ski poles 90 from the straps 110, 112 and travel with the water skis 10.

In use, the water skis 10 may be used in a like manner to cross-country skis. The user may thrust forward with the right foot while pushing rearward with the left foot to propel the user across the water without the need to be towed by a power boat. The directional dependence of hydrodynamic drag on the propulsion structures 20 results in the right ski 10 moving forward more than the left ski 10 is moved back. This process may be repeated by pushing forward with the left foot while pushing rearwardly with the right foot, resulting in left ski 10 moving forward more than the right ski 10. This process may be repeated. The water ski poles 90 may be held in the right and left hands of the user, who may use the water ski poles 90 to provide one or both of stability and propulsion. In particular, use of the water ski poles 92 together with the water skis 10 in this manner gives a synergistic increase in thrust and waterskiing speed as the skier propels himself/herself across the surface of the water. For example, the user may push back on a right water ski pole 90 when pushing forward on the right ski 10. Likewise, the user may push back on the left water ski pole 90 when pushing forward on the left ski 10.

The water skis 10 may be made in a large variety of sizes. In particular, the length and width of the water skis 10 may be varied in order to accommodate users of different sizes and weights. Likewise, the sizes and numbers of the propulsion structures 20 may be varied FIG. 11 illustrates different example combinations of sizing parameters. In FIG. 11, "Height of Arcs" refers to the height of the propulsion surface 40 shaped as an arc. "Area of Concave Arc" refers to the area of the propulsion surface 40. "Width of Ski" refers to the width of the ski in the transverse direction 12*c*. "Area of Arcs" refers to the total area of the propulsion surfaces 40 of all of the propulsion structures 20 of the water ski. "Number of Arcs" refers to the number of propulsion structures (each pair of partial-width propulsion structures 20 may be treated as a single arc for this count). "Total Area of Arcs (square inches) on Bottom of Each Ski" refers to the area of arcs or propulsion structures 20 on the base 14 on which arcs are formed.

FIG. 12 provides additional combinations of sizing parameters related to the weight of the person using the skis 10. In the illustrated table, columns labeled L refer to length in the longitudinal dimension 12*a* as do phrases of the form "X' long." Columns labeled W refer to width in the transverse direction 12*c* as do phrases of the form "X" wide." Columns labeled "Disp." refers to the displacement of the water ski 10 in cubic inches for the listed structure (Water Ski, Front Buoyancy Structure, and Rear Buoyancy Structure). "Lbs" refers to rider weight in pounds that may be supported by the listed structure. In FIG. 12, "Water Ski Displacement" refers to the base 14 and propulsion structures 20 without the buoyancy structures 24*a*, 24*b*, "Front Buoyancy Structure" refers to buoyancy structure 24*a* and "Rear Buoyancy Structure" refers to buoyancy structure 24*b*.

Various refinements to the embodiments described above may be used. For example, the width of the water skis 10 shown above is uniform other than the tapered tip and any slight (2 inch or smaller radius) rounding at the rear corners. Likewise, propulsion structures 20 may have rounded edges and corners. In other embodiments, the width of the water skis 10 tapers and becomes narrower moving toward the rearward end 18. In other embodiments, the sides of the water skis 10 bow outwardly between the tip 16 and rearward end 18. In still other embodiments, the sides of the water skis 10 bow inwardly in the planar portion of the base 14 several inches in back of the tip 16 and forward of the rearward end 18.

The water skis 10 described above are encased in a shell made of plastic, composite material, or other rigid material. In other embodiments, the water skis 10 may be inflatable, such as using strain-locking threads as may be used for stand-up paddle boards.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What are claimed are listed below:

1. A water ski comprising:

a base defining a longitudinal direction, a transverse direction perpendicular to the longitudinal direction, and a vertical direction perpendicular to the longitudinal direction and the transverse direction, the base having a tip and a rearward end offset from one another along the longitudinal direction, the base including a planar portion extending from the rearward end and an upwardly curved portion extending from the planar portion to the tip and being rounded upwardly from the planar portion along the longitudinal direction, the planar portion being parallel to the longitudinal direction and the transverse direction, the base being buoyant in water and having a displacement of at least 36 pounds; and a plurality of propulsion structures secured to the base, each propulsion structure of the plurality of propulsion structures having a propulsion surface that extends downwardly from the planar portion in the vertical direction, the propulsion surface of each propulsion structure having both (a) a chevron shape in a plane parallel to the longitudinal direction and the transverse direction and (b) a concave shape in a plane parallel to the vertical direction and the longitudinal direction, the propulsion surface facing rearwardly toward the rearward end, the plurality of propulsion structures further each defining a surface sloping forward from the propulsion surface and upward to the planar portion.

2. The water ski of claim 1, wherein the concave shape is an arcuate shape.

3. The water ski of claim 1, wherein the propulsion surface spans at least 90 percent of a width of the base in the transverse direction.

4. The water ski of claim 1, wherein each propulsion structure of the plurality of propulsion structures has a width in the transverse direction that is no wider than half of a width of the base in the transverse direction and are arranged such that each propulsion structure overlaps one or more other propulsion structures of the plurality of propulsion structures along the longitudinal direction.

5. The water ski of claim 1, further comprising one or more vanes secured to the planar portion and extending downwardly from the planar portion, the one or more vanes having a length in the longitudinal direction at least 15 times greater than a width of the one or more vanes in the transverse direction and having a height between two and ten inches.

6. The water ski of claim 1, further comprising a vane secured to the planar portion and extending downwardly from the planar portion, the vane having a length in the longitudinal direction at least 15 times greater than a width of the vane in the transverse direction and having a height between two and ten inches;

wherein a first portion of the propulsion structures overlapping the vane in the longitudinal direction having a different size than a second portion of the propulsion structures that do not overlap the vane in the longitudinal direction, a width of the propulsion structures of the first portion being less than half of a width of the propulsion structures of the second portion.

7. The water ski of claim 1, further comprising one or more buoyancy structures secured to an upper surface of the base opposite a bottom surface of the base, the propulsion structures being secured to the bottom surface, the one or more buoyancy structures positioned inwardly from one or both edges of the base.

8. The water ski of claim 7, further comprising a shell encasing the base and buoyancy structures, the shell comprising at least one of plastic, fiberglass composite material, and carbon fiber composite material.

9. The water ski of claim 8, further comprising a bottom layer secured to a bottom surface of the shell, the bottom layer having the plurality of propulsion structures secured thereto.

10. The water ski of claim 9, wherein the bottom layer defines a recess, the base being positioned within the recess.

11. A water ski comprising:

a base defining a longitudinal direction, a transverse direction perpendicular to the longitudinal direction, and a vertical direction perpendicular to the longitudinal direction and the transverse direction, the base having a tip and a rearward end offset from one another along the longitudinal direction, the base including a planar portion extending from the rearward end and an upwardly curved portion extending from the planar portion to the tip and being rounded upwardly from the planar portion along the longitudinal direction, the planar portion being parallel to the longitudinal direction and the transverse direction, the base being buoyant in water and having a displacement of at least 36 pounds;

a plurality of propulsion structures secured to the base, each propulsion structure of the plurality of propulsion structures having a propulsion surface that extends downwardly from the planar portion in the vertical direction, the propulsion surface of each propulsion structure having both (a) a first concave shape in a plane parallel to the longitudinal direction and the transverse direction and (b) a second concave shape in a plane parallel to the vertical direction and the longitudinal direction, the propulsion surface facing rearwardly toward the rearward end, the plurality of propulsion structures further each defining a surface sloping forward from the propulsion surface and upward to the planar portion;

one or more buoyancy structures secured to an upper surface of the base opposite a bottom surface of the base, the propulsion structures being secured to the bottom surface, the one or more buoyancy structures positioned inwardly from one or both edges of the base;

a shell encasing the base and buoyancy structures, the shell comprising at least one of plastic, fiberglass composite material, and carbon fiber composite material; and one or more vertical supports extending one or both of along edges of the base and embedded within the base, the one or more vertical supports having a height in the vertical direction that is at least 100 times a thickness of the vertical supports in the transverse direction, the one or more vertical supports being encased in the shell and comprising at least one of plastic, metal, fiberglass composite, carbon fiber composite, and wood.

12. The water ski of claim 7, further comprising A water ski comprising:

a base defining a longitudinal direction, a transverse direction perpendicular to the longitudinal direction, and a vertical direction perpendicular to the longitudinal direction and the transverse direction, the base having a tip and a rearward end offset from one another along the longitudinal direction, the base including a planar portion extending from the rearward end and an upwardly curved portion extending from the planar portion to the tip and being rounded upwardly from the planar portion along the longitudinal direction, the planar portion being parallel to the longitudinal direction and the transverse direction, the base being buoyant in water and having a displacement of at least 36 pounds;

a plurality of propulsion structures secured to the base, each propulsion structure of the plurality of propulsion structures having a propulsion surface that extends downwardly from the planar portion in the vertical direction, the propulsion surface of each propulsion structure having both (a) a first concave shape in a plane parallel to the longitudinal direction and the transverse direction and (b) a second concave shape in a plane parallel to the vertical direction and the longitudinal direction, the propulsion surface facing rearwardly toward the rearward end, the plurality of propulsion structures further each defining a surface sloping forward from the propulsion surface and upward to the planar portion;

one or more buoyancy structures secured to an upper surface of the base opposite a bottom surface of the base, the propulsion structures being secured to the bottom surface, the one or more buoyancy structures positioned inwardly from one or both edges of the base; and a binding secured to the upper surface of the base, the one or more buoyancy structures comprising a first buoyancy structure secured to the upper surface of the base forward of the binding and a second buoyancy structured secured to the upper surface rearward of the binding.

13. The water ski of claim 1, further comprising a binding secured to the upper surface of the base, the binding comprising:

a toe portion sized to receive a toe of a user's foot;

a heel strap secured to at least one of the toe portion and the base and configured to engage a heel of the user's foot, the heel strap configured to permit the heel of the user's foot to raise when engaged with the heel of the user's foot and while the toe of the user's foot is inserted in the toe portion.

14. The water ski of claim 13, wherein the heel strap comprises a first strap with a first fastening portion and a second strap with a second fastening portion configured to selectively secure with the first fastening portion.

15. The water ski of claim 13, wherein the water ski is a first water ski for use in combination with a second water ski, the first water ski further comprising one or more first pole straps secured to the base forward of the binding and one or more second pole straps secured to the base rearward of the binding, the one or more first pole straps configured to secure to a first water ski pole and the one or more second pole straps configured to secure to a second water ski pole such that when the first water ski pole and second water ski pole are also secured to the second water ski, the first water ski pole and the second water ski pole function as outriggers for stabilizing the first water ski and the second water ski while a user is boarding the first water ski and the second water ski.

16. The water ski of claim 15, wherein the one or more first pole straps comprise two first pole straps separated from one another by at least half of a width of the base and the one or more second pole straps comprise two second pole straps separated from one another by at least half of the width of the base.

17. The water ski of claim 1, further comprising a water ski pole, the water ski pole comprising a rod having a handle at a first end of the rod and float within four inches of a second end of the rod opposite the first end, the float having a displacement of at least 20 lbs.

18. A water ski comprising:

a base defining a longitudinal direction, a transverse direction perpendicular to the longitudinal direction, and a vertical direction perpendicular to the longitudinal direction and the transverse direction, the base having a tip and a rearward end offset from one another along the longitudinal direction, the base including a planar portion extending from the rearward end and an upwardly curved portion extending from the planar portion to the tip and being rounded upwardly from the planar portion along the longitudinal direction, the planar portion being parallel to the longitudinal direction and the transverse direction, the base being buoyant in water and having a displacement of at least 36 pounds;

a plurality of propulsion structures secured to the base, each propulsion structure of the plurality of propulsion structures having a propulsion surface that extends downwardly from the planar portion in the vertical direction, the propulsion surface of each propulsion structure having both (a) a first concave shape in a plane parallel to the longitudinal direction and the transverse direction and (b) a second concave shape in a plane parallel to the vertical direction and the longitudinal direction, the propulsion surface facing rearwardly toward the rearward end, the plurality of propulsion structures further each defining a surface sloping forward from the propulsion surface and upward to the planar portion; and a water ski pole, the water ski pole comprising a rod having a handle at a first end of the rod and float within four inches of a second end of the rod opposite the first end, the float having a displacement of at least 20 lbs;

wherein a lower surface of the float defines a recess having a depth of between 0.25 to 0.5 inches.

19. A water ski comprising:

a base defining a longitudinal direction, a transverse direction perpendicular to the longitudinal direction, and a vertical direction perpendicular to the longitudinal direction and the transverse direction, the base having a tip and a rearward end offset from one another along the longitudinal direction, the base including a planar portion extending from the rearward end and an upwardly curved portion extending from the planar portion to the tip and being rounded upwardly from the planar portion along the longitudinal direction, the planar portion being parallel to the longitudinal direction and the transverse direction, the base being buoyant in water and having a displacement of at least 36 pounds; and a plurality of propulsion structures secured to the base, each propulsion structure of the plurality of propulsion structures being a rigid structure having a propulsion surface that extends downwardly from the planar portion in the vertical direction, the propulsion surface of each propulsion structure having both (a) a first concave shape in a plane parallel to the longitudinal direction and the transverse direction and (b) a second concave shape in a plane parallel to the vertical direction and the longitudinal direction, the propulsion surface facing rearwardly toward the rearward end, the plurality of propulsion structures further each defining a sloped surface sloping forward from the propulsion surface and upward to the planar portion;

wherein each propulsion structure of the plurality of propulsion structures has an upper edge at the planar portion and a lower edge offset below the upper edge by a thickness along the vertical direction such that both of the upper edge and the lower edge have a same second concave shape, the propulsion surface of the each propulsion structure being positioned between the upper edge and the lower edge, the sloped surface of the each propulsion structure sloping forwardly and upwardly from the lower edge.

* * * * *